US012448970B2

(12) United States Patent
Lee et al.

(10) Patent No.: US 12,448,970 B2
(45) Date of Patent: Oct. 21, 2025

(54) HORIZONTAL ROTARY COMPRESSOR WITH ENHANCED TILTABILITY DURING OPERATION AND OTHER PERFORMANCE METRICS

(71) Applicant: ASPEN COMPRESSOR, LLC, Marlborough, MA (US)

(72) Inventors: Kang P. Lee, Sudbury, MA (US); Kevin Olsen, Natick, MA (US)

(73) Assignee: ASPEN COMPRESSOR, LLC, Marlborough, MA (US)

( * ) Notice: Subject to any disclaimer, the term of this patent is extended or adjusted under 35 U.S.C. 154(b) by 0 days.

(21) Appl. No.: 18/132,877

(22) Filed: Apr. 10, 2023

(65) Prior Publication Data

US 2023/0313797 A1 Oct. 5, 2023

Related U.S. Application Data

(63) Continuation of application No. 17/167,017, filed on Feb. 3, 2021, now Pat. No. 11,655,820.
(Continued)

(51) Int. Cl.
*F04C 29/02* (2006.01)
*F04C 23/00* (2006.01)

(52) U.S. Cl.
CPC ..... *F04C 29/028* (2013.01); *F04C 23/008* (2013.01); *F04C 29/025* (2013.01);
(Continued)

(58) Field of Classification Search
CPC ..... F04C 15/0088; F04C 15/0092; F04C 29/028; F04C 29/02; F04C 29/021;
(Continued)

(56) References Cited

U.S. PATENT DOCUMENTS 2,948,458 A * 8/1960 Nicholas ..... F04B 39/128 417/372
2,991,931 A 7/1961 Galin
(Continued)

FOREIGN PATENT DOCUMENTS

CH 98303 A 3/1923
CN 1420282 A 5/2003
(Continued)

OTHER PUBLICATIONS

[No Author Listed], Aspen's New, Miniature, Rotary BLDC Compressors with 360 & 455W Ashrae LBP Ratings. Aspen Compressor. 2013. 1 page.
(Continued)

*Primary Examiner* — Thomas Fink
(74) *Attorney, Agent, or Firm* — Wolf, Greenfield & Sacks, P.C.

(57) ABSTRACT

This disclosure describes new horizontal roller-piston/vane type rotary compressors with novel features such as new lubricating oil circuit designs to provide reliable oil lubrication, and increase tiltability during operation. Also new multi-pump configurations of horizontal compressors are introduced in order to significantly increase redundancy, reliability, and turn down ratio. Rotary compressors may be configured with subsets of the disclosed features to configure those compressors for specific applications.

14 Claims, 18 Drawing Sheets

Related U.S. Application Data

(60) Provisional application No. 62/969,896, filed on Feb. 4, 2020.

(52) U.S. Cl.
CPC ..... *F04C 29/026* (2013.01); *F04C 2240/30* (2013.01); *F04C 2240/809* (2013.01)

(58) Field of Classification Search
CPC ..... F04C 2270/024; F04C 2240/809; F04C 23/008; F04C 29/025; F04C 29/026; F04C 2240/30; F04C 18/34; F04B 39/02–0292; F04B 53/18
See application file for complete search history.

(56) References Cited

U.S. PATENT DOCUMENTS 3,105,633 A 10/1963 Dellario
3,240,424 A 3/1966 Richardson
3,423,013 A 1/1969 Rinehart
3,913,346 A 10/1975 Moody, Jr. et al.
4,187,064 A 2/1980 Wheeler
4,416,594 A * 11/1983 Ichikawa ..... F04B 35/045 417/372
4,470,778 A * 9/1984 Mabe ..... F04C 29/026 418/55.6
4,557,677 A 12/1985 Hasegawa
4,712,986 A * 12/1987 Nissen ..... F04C 29/025 418/94
4,729,728 A * 3/1988 Gromoll ..... F25B 31/002 418/94
5,012,896 A * 5/1991 Da Costa ..... F04C 23/008 184/6.16
5,060,759 A * 10/1991 Dussourd ..... F04C 23/008 418/94
5,221,191 A * 6/1993 Leyderman ..... F04C 23/008 417/372
5,222,885 A * 6/1993 Cooksey ..... F04C 29/023 418/94
5,322,420 A * 6/1994 Yannascoli ..... F04C 29/023 417/366
5,580,233 A * 12/1996 Wakana ..... F04C 23/008 418/55.6
5,640,854 A 6/1997 Fogt et al.
5,683,237 A * 11/1997 Hagiwara ..... F04C 29/02 418/55.6
6,050,794 A * 4/2000 Noboru ..... F04C 29/025 418/55.6
6,152,714 A 11/2000 Mitsuya et al.
6,171,076 B1 * 1/2001 Gannaway ..... F04C 18/3442 417/244
6,264,446 B1 * 7/2001 Rajendran ..... F04C 23/008 418/55.6
6,322,339 B1 * 11/2001 Mitsunaga ..... F04C 29/021 418/55.6
7,040,840 B2 5/2006 Zook
7,946,831 B2 * 5/2011 Roller ..... F04C 23/008 418/55.6
8,096,794 B2 * 1/2012 Iwanami ..... F01C 21/10 418/55.6
8,506,272 B2 * 8/2013 Fan ..... F04C 29/023 418/94
8,747,088 B2 * 6/2014 Elson ..... F04C 29/023 418/94
11,655,820 B2 5/2023 Lee et al.
2003/0094007 A1 5/2003 Choi et al.
2005/0069445 A1 * 3/2005 Ebara ..... F04C 23/001 418/63
2006/0008360 A1 1/2006 Nishikawa et al.
2007/0077161 A1 * 4/2007 Roller ..... F04C 23/008 418/55.6
2007/0092391 A1 * 4/2007 Elson ..... F04C 23/008 418/55.6
2009/0280020 A1 * 11/2009 Takeda ..... F04C 23/008 418/88
2010/0098570 A1 * 4/2010 Bodart ..... F04C 29/021 418/87
2013/0098100 A1 * 4/2013 Bonnefoi ..... F04B 39/0238 62/468
2014/0056727 A1 * 2/2014 Koyama ..... F04C 18/0215 417/228
2015/0125330 A1 5/2015 Komura et al.
2015/0276282 A1 10/2015 Heiden et al.
2016/0201669 A1 7/2016 Ryu et al.
2017/0002834 A1 1/2017 Powell et al.
2017/0248356 A1 8/2017 Lee et al.
2017/0306951 A1 * 10/2017 Chikano ..... F04C 23/008
2019/0101207 A1 * 4/2019 Tanka ..... F16H 57/0443
2020/0232687 A1 * 7/2020 Guo ..... F04B 39/0207
2021/0164462 A1 * 6/2021 Sun ..... F04C 15/06
2021/0239118 A1 8/2021 Lee et al.
2022/0090829 A1 3/2022 Lee et al.

FOREIGN PATENT DOCUMENTS

EP 3406905 A1 11/2018
JP H05-10278 A 1/1993
JP 2012-247134 A 12/2012
WO WO 2015/081338 A1 6/2015

OTHER PUBLICATIONS

[No Author Listed], Q-Series Low Noise Miniature, Rotary BLDC Refrigeration Compressors. Aspen Compressor. Dec. 2013. 2 pages.
Dellinger, The temperature coefficient of resistance of copper. Bulletin of the Bureau of Standards. Nov. 1910;7(I):71-97. 31 pages.
Kim et al., Development of High-Side Shell Scroll Compressor with Novel Oil Return Mechanism. International Compressor Engineering Conference. Paper 2023. 2010. 8 pages.
Lungoci et al., Temperature effects on torque production and efficiency of motors with NdFeB. Revue Roumaine des Sciences Techniques. Serie Electrotechnique et Energetique. 2008;53(4):445-454.
Montone, Understanding dc motor curves and temperature: Part 2. Motors/Ametek Precision Motion Control. Dec. 6, 2013. 20 pages. URL:https://www.motioncontroltips.com/understanding-dc-motor-curves-temperature-part-2 [retrieved on May 12, 2021].

* cited by examiner

| X-axis | Y-axis | |
|---|---|---|
| Pitch Angle | Max Roll Angle Counter-Clockwise | Max Roll Angle Clockwise |
| (Degrees) | (Degrees) | (Degrees) |
| -90 | 0 | 0 |
| -75 | 0 | 0 |
| -60 | 0 | 0 |
| -45 | 0 | 0 |
| -30 | 0 | 0 |
| -15 | 0 | 0 |
| 0 | 52 | -52 |
| 15 | 97 | -97 |
| 30 | 128 | -128 |
| 45 | 151 | -151 |
| 60 | 168 | -168 |
| 75 | 180 | -180 |
| 90 | 180 | -180 |

| X-axis | Y-axis | |
|---|---|---|
| Pitch Angle | Max Roll Angle Counter-Clockwise | Max Roll Angle Clockwise |
| (Degrees) | (Degrees) | (Degrees) |
| -90 | 0 | 0 |
| -75 | 2 | -2 |
| -60 | 14 | -14 |
| -45 | 33 | -33 |
| -30 | 51 | -51 |
| -15 | 56 | -56 |
| 0 | 44 | -44 |
| 15 | 56 | -56 |
| 30 | 51 | -51 |
| 45 | 33 | -33 |
| 60 | 14 | -14 |
| 75 | 2 | -2 |
| 90 | 0 | 0 |

FIG. 7

HORIZONTAL ROTARY COMPRESSOR WITH ENHANCED TILTABILITY DURING OPERATION AND OTHER PERFORMANCE METRICS

RELATED APPLICATIONS

This application is a continuation of U.S. application Ser. No. 17/167,017, filed Feb. 3, 2021, which claims the benefit under 35 U.S.C. § 119(e) of U.S. Provisional Application No. 62/969,896, filed Feb. 4, 2020. The contents of these applications are incorporated herein by reference in their entirety.

BACKGROUND

There are very few horizontal rotary compressor models commercially available or used in any significant quantities. They all have very limited "tiltability" therefore causing serious lubrication deficiency in many applications where the vapor compression system and its compressor will be tilted which in turn result in reduced cooling performance, reduced life expectancy, reliability, etc. Simplest one of them is a horizontal rotary compressor produced by Tecumseh which uses a cap covering over the nose of a what would be a "lower" flange for a vertical compressor with a tube attached to and extending downward into the oil sump below (by welding, brazing or pressure fitting) to draw the oil from the sump below into the central cavity of the crankshaft. FIG. 1 shows the region of acceptable operation in terms of pitch and roll angle for the conventional horizontal rotary compressor (denoted by the rectangle a-a-a-a) in comparison to the that of the vertical rotary compressor (denoted by the curve b-b-b). It shows that the conventional horizontal compressor has higher rollability superior to vertical rotary compressors starting from around ~−7-degree pitch angle to 90-degree pitch angle. However, pitching beyond −7 degrees, its rollability rapidly decreases and becomes zero at −15 degrees which means for all practical purposes, one cannot use the conventional horizontal rotary compressors much beyond −7 degrees of pitch angle. Most vehicle or mobile operations require a minimum rollability of 30 degrees up to −30 pitch angle which vertical rotary compressors barely satisfy as shown in FIG. 1. Some other mobile applications require 60-degree solid angle tilt or even higher. Whereas the vertical rotary compressor can fully tolerate pitch angle range of +/−30 degrees with the roll angle range of +/−30 degrees across the pitch angle range of +/−30 degrees, the conventional horizontal rotary compressor cannot operate at all when the motor side is sloping downward beyond 15 degrees, i.e., −15 degrees: at −15 degree pitch angle, there is zero rollability: meaning it cannot operate with any degree of roll angle off its nominal orientation. The range of acceptable roll angle increases to 52 degrees as the pitch angle approaches 0 degrees and gradually approaches +/−90 degrees. This configuration may be acceptable to certain limited applications where the motor side of the compressor is not tilting downward and there is very little roll angle. This is a serious limitation for mobile applications especially.

On another front, the current method of attachment and sealing between the cap and the flange nose of a conventional horizontal compressor may be acceptable for a fairly beefy flange nose of a large compressor. However, for smaller displacement compressors with smaller flanges and thinner bearing wall for the flange, such as with a displacement less that 5 cc, the same methods would be unacceptable to use due to potential dimensional changes or distortions of parts that these methods of attachment may cause, i.e., warping of the flange whose face acts as the cylinder wall as the roller-piston slides/rotates across its flat face which requires very tight and uniform clearance between the roller and the flange face for good lubrication and sealing, and whose bore acts as a bearing for the crankshaft. The existing designs do not provide much of tiltability required in various applications such as vehicles, trains, airplanes, earth moving machines, robots, etc.

It would be highly desirable to have horizontal compressors that can be used in far wider cooling or heating applications including tilt-prone mobile applications such as automobiles, electric vehicles, trucks, trains, aircraft, drones, helicopters, spacecraft, recreational vehicles, boats, ships, laser projectors, laser weapons, robots, earth moving equipment, etc. where the vapor compression system operates in a wide ranging tilt (both pitch and roll) angles off the nominal horizontal orientation. It would also be highly desirable to have an extremely reliable, highly efficient horizontal compressor with significantly increased turndown ratio and longer life to be used in ubiquitous and fast growing large scale stationary applications such as highly efficient distributed HVAC systems in buildings and homes, and data centers which would fully take advantage of a horizontal compressor's distinct feature of much lower height and low height rack mounted or low thickness, vertical cooling systems while providing high cooling or heating capacity with excellent energy efficiency, reliability and/or redundancy.

To date, there have been several attempts by various companies and inventors to build or design horizontal rotary compressors with increased tiltability (mostly in pitch angle but not much in roll angle with respect to the nominally horizontal axis of the pump and operating without much regard to roll angle) by having a mechanism to increase oil levels in the pump space as described below. These approaches will make the oil level to go up well above what is possible without the described features and therefore would increase the acceptable pitch angle and the roll angle moderately. However, upon close scrutiny, they do not seem to be tenable or practical for reasons that are related to insufficient motor cooling or other reasons described below.

U.S. Pat. No. 4,557,677 describes a horizontal rotary compressor with oil pumping mechanism utilizing the movement of vane to pump oil into the center axial cavity of the crankshaft of a rotary compressor. This mechanism potentially disrupts and adversely affect the vane dynamics and wear due to added oil pumping load. Its extra pumping to increase the pressure also turns out to be unnecessary because the discharge pressure in the shell of a high shell rotary compressors, which most rotary compressors fall into, is more than sufficient to pump oil into the center axial cavity of the crankshaft which is at a lower pressure than the shell pressure. This oil pumping mechanism relying on the pressure difference between the oil sump and the internal parts of the pump has been successfully and satisfactorily used in vertical rotary compressors for several decades now.

All one has to do is to make sure the oil sump which is already at discharge pressure has pathway to supply oil to the center axial cavity, and for a horizontal compressor, this task is even easier owing to the fact that the oil has less height to overcome. One of the simplest approaches would be using a simple extension tube that connects the oil sump to the center axial cavity of the crank shaft via the end of the "lower" flange as used by the horizontal compressor manufactured by Tecumseh. A vast majority of vertical rotary compressors used today are high-shell rotary compressors where the pressure inside the shell is uniformly at discharge pressure and therefore having the bottom of the lower flange dipped into the oil sump is enough to pump the oil into the central cavity of the shaft from which the oil is pumped into the moving parts of the pump even without the small screw pump normally inserted inside the flange bore to push up the oil from the oil sump into the central cavity of the crankshaft. This oil supply mechanism has proven to be more than adequate over several decades of use of high shell rotary compressors around the world. Therefore, there seems to be no special or practical reason or potential benefit to use the proposed method of using the vane to pump oil as described especially taking into the added complexity.

U.S. Pat. No. 5,012,896, describes a configuration of a horizontal rotary compressor using a partition within the shell that divides the shell into the motor space and pump space. The partition has two holes: one near the top is the gas passage and the other at the bottom is the oil passage. According to its description, discharge gas comes out of the muffler to impinge on the surface of the motor, but instead of flowing through the air gap between the stator and the rotor to cool the motor, the discharge gas gets diverted away from the motor and out of the motor space, without having the opportunity to sufficiently cool the motor, flows back into the pump assembly space through an open hole (orifice) in the top portion of the partition with the purpose of creating a pressure drop, and goes out of the pump space through the discharge tube connected to the pump side. Some of the oil which was entrained in the discharge gas gets separated after the discharged into the motor space, gathers at the bottom of the shell in the motor space. Because the motor space upstream of the orifice has higher pressure than the pump space which is downstream of the orifice, oil is pumped into the pump space through the oil passage provided at the bottom of the partition. This slight pressure differential caused by the flow paths of the discharge gas pushes the oil from the motor space to the pump space and elevates the oil level in the pump space to make sure the pump gets sufficient oil when the compressor is operating while tilted to a limited extent. This design only slightly increases the tiltability in pitch angle in only one direction but not much in roll angle. Unfortunately, this configuration severely restricts the heat removal from the motor section because the discharge gas flow is diverted from the motor by having the discharge tube near the pump away from the motor section. This makes the design not useful in practice because the motor will overheat easily and get damaged prematurely damaging the compressor.

U.S. Pat. No. 5,222,885 (1993) also has similar feature and functionality as the above patent of raising the oil level near the crank shaft oil intake port. However, unfortunately, this configuration also severely restricts the heat removal from the motor section by diverting the discharge gas flow from the motor by having the discharge tube near the pump away from the motor section and therefore suffers from the same insufficient motor cooling as others, and as such is not a design that can be used in practical applications.

U.S. Pat. No. 5,322,420 (1994) describes a horizontal rotary compressor in which the discharge gas travels through the passage inside the crank shaft while working as a jet pump for the oil to lubricate the pump assembly. While this concept forces the entire discharge gas flow through the annular gap between the stator and the rotor unlike the above two patents, there are two glaring disadvantages or flaws: one critical flaw is that the oil/refrigerant gas mixture which are often miscible with each other by design may not become well separated within the internal cavity of the rotating crankshaft and even if it could be separated sufficiently, the oil may not be spread on all surfaces of the internal surface of the crankshaft uniformly to gain access to the oil supply ports into interior moving parts of the pump thus creating a potential gas leak between the inside of the pump and the shell as well as oil deficiency inside the pump. The other critical flaw in the design as described in its specification is that the discharge gas exits the motor space and returns to the side of the shell where the pump assembly is located. This will have the undesirable and unintended side effect of heating up the compression chamber and decreasing the volumetric and isentropic efficiency of the compression.

As shown in FIG. 3, U.S. Pat. No. 7,040,840 (2006) describes a configuration of a horizontal rotary compressor in which there is a partitioning member inside a shell creating an oil storage portion space containing the pump assembly and there is a motor containing space. Just like some of the other patents cited above, the partitioning member has oil passage in the lower section and a discharge gas passage in the upper section. Just like the other examples above using pressure differential to pump the oil from the oil sump in the motor space to the sump in the pump space, however, the flow of the discharge gas out of the muffler into the motor space impinges on the motor but is almost immediately diverted back to the pump assembly side through the discharge gas passage of the partitioning member. Again, this design seriously limits the heat transfer between the cooling gas (discharge gas) and the motor by premature diversion of the discharge gas just like the others mentioned above. Insufficient cooling of the motor affects adversely both the motor efficiency, longevity, performance and reliability of the compressor itself. Therefore, this design also is not a practical one due to the same deficiency of insufficient motor cooling.

If adequate oil supply can be assured, a horizontal compressor can be configured to have multiple pump sets within a single shell much more readily than a vertical compressor. Each pump can be paired with a BLDC drive giving a lot of flexibility during operation: they can be run one at a time, both at the same time, or alternately. One could double or triple the capacity of a horizontal compressor without increasing its height, which configuration also may provide built-In redundancy, longer life span, and much higher turn-down ratio with excellent part load efficiency since individual pump set can be run independently. The flexibility of operation would enhance the reliability of the horizontal compressor, its life span, or could provide inherent redundancy for the associated vapor compression system.

Despite the many advantages of lower height of horizontal rotary compressors compared to the vertical rotary compressors and the usefulness in many current and rapidly emerging applications such as in EV and other transportation and data centers, the relative absence and very limited use of commercially available horizontal compressors are not acceptable to most of these applications as a consequence of the critical deficiencies as described above. A widely acceptable horizontal rotary compressor design should maintain the effectiveness of the heat removal from the motor, cause no deterioration of performance due to heating of the pump as well as maintain the integrity of the lubrication system well tested in the vertical rotary compressors for several decades satisfactorily.

In addition, as briefly mentioned above, when the size of the rotary compressor gets smaller, the dimensional integrity of components becomes more of an issue: for example, think of a case when a tube or a cap is to be attached to the end of the flange nose to draw the oil from the sump into the central cavity of the crank shaft such as done in Tecumseh's horizontal compressor. For small compressors such as pump displacement of less than 5 cc, a common means of connecting an oil flow tube or a cap to the lower flange via pressure fit, shrink fit, soldering or welding may distort the inner surface of the flange bore or cause warping of the precision ground flange face which would create undesirable friction or leaks between roller and the flange face to the detriment of the performance and life expectancy. The new horizontal rotary compressors can avoid these issues for these small size horizontal rotary compressors by using inexpensive but practical solution such as thickening the wall of the flange disk or nose beyond the normal thicknesses to prevent distortions or other simple inexpensive measures.

SUMMARY

In some embodiments, a horizontal compressor includes a shell divided into a motor space and a pump space by a separator, where the separator has an oil passage at a lower part of the separator and a gas passage in an upper part connecting the motor space and the pump space. The horizontal compressor also includes a motor positioned in the motor space, a first sump positioned in a lower part of the motor space, a second sump positioned in a lower part of the pump space, and a discharge valve, where discharge gas out of the discharge valve enters the motor space and goes through the motor to provide cooling for the motor and exits the motor into a discharge tube positioned at an end of the motor space. The horizontal compressor also includes a gas tube having a first end and a second end, where the first end is connected to the gas passage of the separator and the second end extends toward and juts into the discharge tube without blocking the discharge tube, where flow of the discharge gas flowing around the end of the gas tube and entering into the discharge tube induces flow of gas from the pump space into the motor space by a jet pump effect which lowers the pressure in the pump space, and where lowering the pressure in the pump space causes oil from the sump in the lower part of the motor space to flow into the sump in the lower part of the pump space. The second sump is positioned at an elevation higher than an elevation of the first sump such that an equilibrium is reached between the oil pumping force of the first sump and the oil pumping force of the second sump.

In some embodiments, a horizontal compressor includes a shell divided into a motor space and a pump space by a separator, where the separator has an oil passage at a lower part of the separator and a gas passage in an upper part connecting the motor space and the pump space, a motor positioned in the motor space including a rotor and a stator separated by a gap, a pump assembly positioned in the pump space, an oil supply tube attached to the oil passage along a bottom portion of the shell, a sump positioned in a lower part of the motor space, wherein the sump is configured to feed oil into the pump assembly via the oil supply tube, and a discharge valve, where discharge gas out of the discharge valve enters the motor space and goes through the gap to provide cooling for the motor and exits the motor into a discharge tube positioned at an end of the motor space.

In some embodiments, a horizontal compressor includes a shell divided into a motor space and a pump space by a separator, where the separator has an oil passage at a lower part of the separator and a gas passage in an upper part connecting the motor space and the pump space, a motor positioned in the motor space, a pump assembly positioned in the pump space, a first sump positioned in a lower part of the motor space, wherein the first sump is configured to feed oil into the pump assembly via the oil passage, a second sump positioned in a lower part of the pump space, and an oil supply tube attached to the oil passage along a bottom portion of the shell, wherein an end of the oil supply tube is configured to remain submerged in oil at a maximum allowable tilt angle.

BRIEF DESCRIPTION OF DRAWINGS

FIG. 7 depicts a table of maximum allowable roll angles as a function of pitch angle of the compressor of FIG. 5;

DETAILED DESCRIPTION

This disclosure describes new horizontal roller-piston/vane type rotary compressors with novel features such as new lubricating oil circuit designs to provide reliable oil lubrication, and increase tiltability during operation. Also new multi-pump configurations of horizontal compressors are introduced in order to significantly increase redundancy, reliability, and turn down ratio. By combining an appropriate set of these new features, the new horizontal compressors will be useful to a wide range of stationary and mobile applications, both existing and emerging. They would enable new compact cooling system configurations that are well suited for applications that favors extremely low height in a horizontal system configuration or small front-to-back depth in a vertical system configuration.

Figure 1:
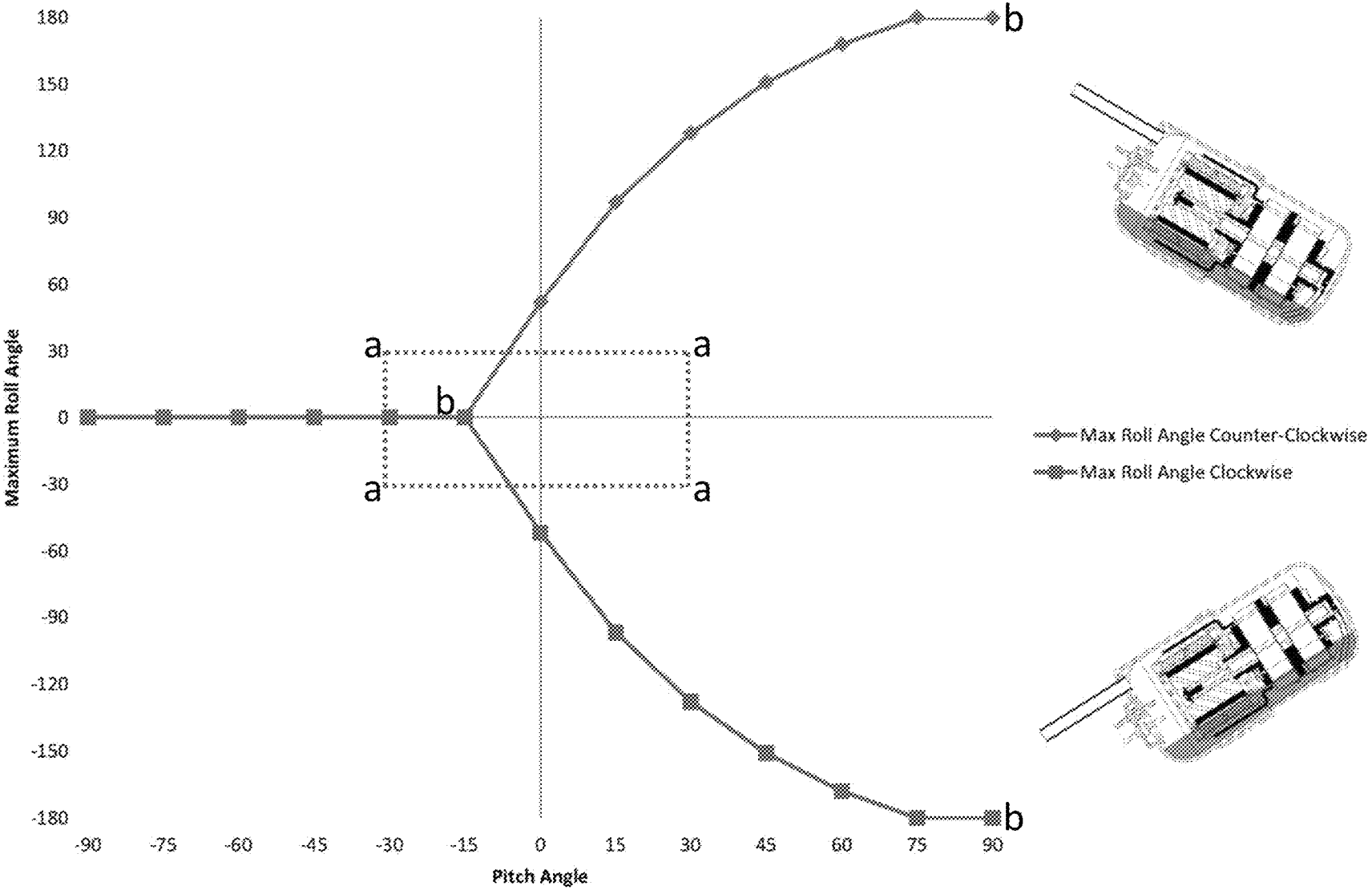
FIG. 1 depicts a chart showing a maximum allowable roll angle as a function of pitch angle for a vertical rotary compressor and conventional horizontal compressor.
Figures 2, 3:
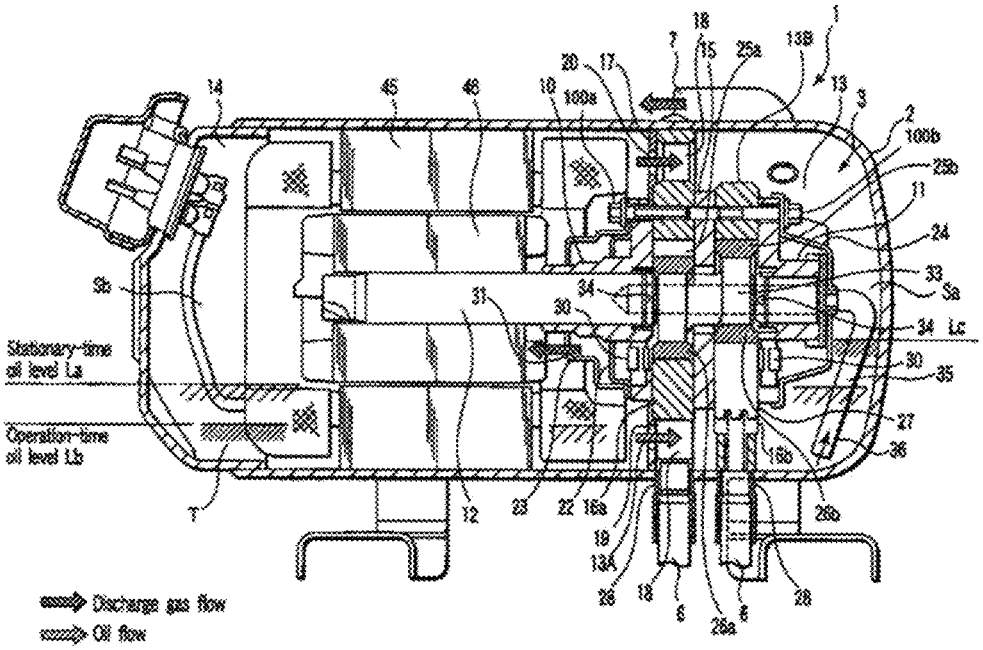
FIG. 3 (PRIOR ART)
FIG. 2 depicts a table of maximum allowable roll angles as a function of pitch angle for a conventional horizontal compressor.
FIG. 3 depicts a conventional horizontal compressor.

Most rotary compressors commercially available and used are vertical compressors designed to operate with the axis of rotation of their mechanical pump and the motor in a gravitationally vertical orientation with tiltability of up to 30-degree solid angle off the vertical orientation. The dotted rectangle denoted by a-a-a-a in FIG. 1 shows the acceptable areas of tilted operation in terms of range of pitch angle of +/−30 degrees and roll angle of +/−30 degrees for vertical rotary compressors. Up to 30 degree of tilt (pitch and roll) off the nominally vertical axis of rotation for the vertical rotary compressors, the oil intake port at the bottom of the shaft is submerged in the oil sump and the oil gets pushed into the center cavity of the shaft provide adequate supply of oil to ensure good lubrication and sealing between moving parts, since aft. This means the rotary compressor can operate without any degradation of performance and longevity so long as the axis of the compressor is within 30 degrees of the vertical direction defined by gravity. This makes the vertical rotary compressors useful for most vapor compression applications, stationary and mobile.

However, their relatively tall height presents an insurmountable obstacle to build low height cooling systems. For example, it would be quite desirable to have vapor compression cooling or heating systems with a very low height configuration in many applications including a low height, rack mounted cooling systems or other height limited applications such as vapor compression air conditioners or heat pumps for automobiles or air transportation systems where the available height comes at a premium or an adequate height is not available for a desired cooling or heating capacity while the lateral space is more readily available. In vertical compressors, in order to increase capacity, the height of the compressor may need to be increased which would make it all the more difficult to keep the system height low. In contrast, it is much easier to put multiple pump-motor sets in a horizontal configuration by utilizing the available lateral space without raising the height while doubling or tripling the system capacity depending on the number of pump-motor sets within. It also turns out in the new horizontal configurations in this disclosure, it would be possible to increase the acceptable range of tilting for the new horizontal rotary compressors well beyond what has been traditionally possible with vertical rotary compressors further expanding the usefulness of horizontal rotary compressors.

For these reasons, horizontal rotary compressors would be a natural choice for low height preferred cooling or heat pump systems in a horizontal vapor compression system configuration and low front-to-back depth cooling systems in a vertical vapor compression system configuration. In certain other applications such as for mobile applications where low height and ability to perform in various orientation during operation, it would be also desirable to have the maximum allowable operational tilt (pitch and roll) angle to be as high as possible from the nominally horizontal/lateral orientation. In certain applications, much higher cooling or heating capacity may be required within the same low height system. In certain other situations, the long life, high reliability and redundancy of a compressor in case when preventing premature compressor failure becomes an important system requirement. The new horizontal rotary compressors described in this disclosure can be used in all of these applications.

It is not a requirement that a horizontal compressor designed using features as described herein be universally useful. Rather, various embodiments of horizontal rotary compressors may be constructed by including a subset of the features described herein in order to build a horizontal rotary compressor incorporating only the right set of features for each specific application. For example, the following list gives an idea on key desired characteristics or features for each specific application:

- Data Center Server Rack cooling: high reliability, low vibration, redundancy, long life (100,000 hours or higher) and very high energy efficiency resulting in significant reduction in overall data center wide energy use through distributed cooling for individual server racks
- Medical Equipment cooling: high reliability, medium life (50,000 to 100,000 hours), low noise and vibration, and redundancy
- Air conditioning, heating and cooling for EV's, utility vehicles, trains, airplanes, helicopters: high energy efficiency, reliability, medium life (50,000 to 100,000 hours), medium tiltability up to 30-degree solid angle off nominal orientation
- Laser projector and robot cooling: high tiltability up to 90 degree solid angle orientation, high reliability, low noise and vibration, redundancy, and shorter life (10,000 to 50,000 hours)
- Inner city 5G kiosk cooling: high reliability, long life (100,000 hours or higher) and redundancy There are two general design directions in order to make the new horizontal rotary compressors useful to a wide spectrum of applications.

- Adequate Oil Supply—Ensure that the oil is supplied to the pump parts satisfactorily in as wide a range of operating tilt angle (pitch and roll angle) with respect to the nominally horizontal axis of the pump as possible at affordable/appropriate cost for each category of application.
- Multi-pump Configuration—Increase the capacity, turn down ratio with nearly constant high efficiency, life expectancy, reliability and/or redundancy of a horizontal rotary compressor without increasing the height of the horizontal compressor much if any.

Adequate Oil Supply

Figure 4:
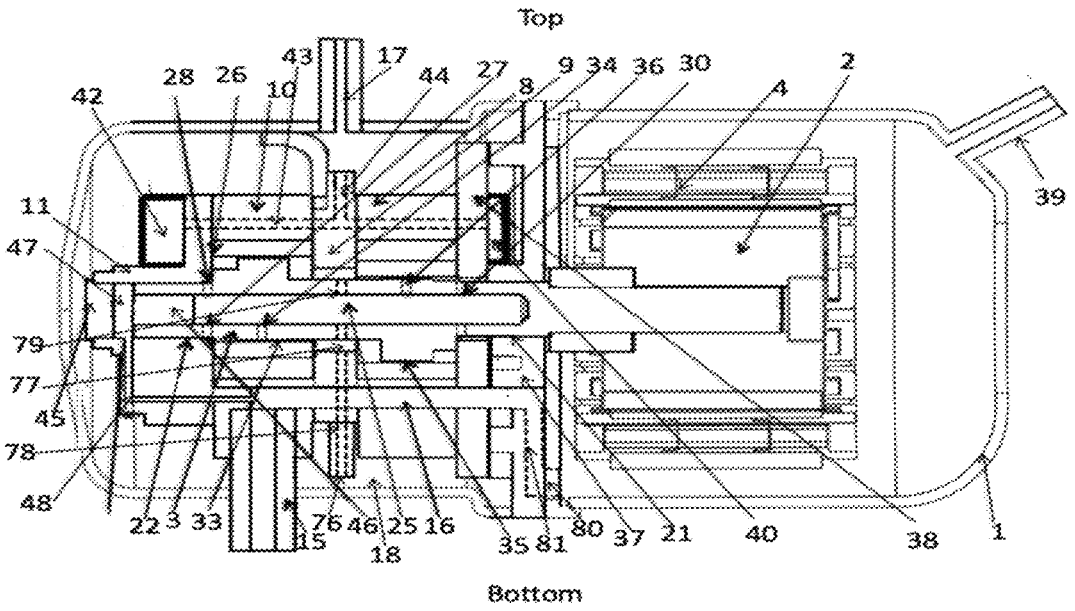
FIG. 4 depicts one embodiment of a high-shell/low-shell horizontal rotary compressor.
Figure 5:
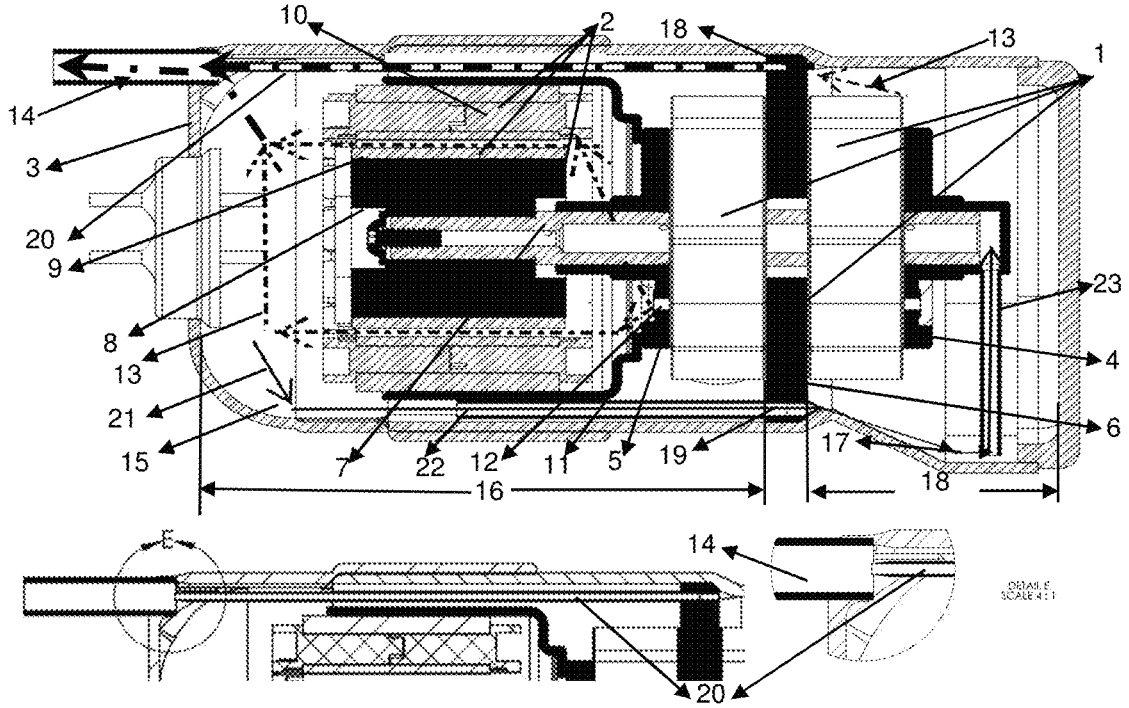
FIG. 5 depicts a schematic of one embodiment of a high-shell rotary compressor with a non-sealing separator, two oil sumps, and jet pump assist in a shell.

The oil in roller piston/vane type compressors defined herein as rolling piston compressor, concentric vane compressor or swing compressors perform the two critical functions: lubrication for moving parts, and sealing between moving parts. It is therefore of critical importance to maintain adequate oil supply under the potential operating conditions. New approaches to the satisfactory oil supply in a horizontal rotary compressor are summarized below and further described in ensuing sections:

a. High-shell/Low-shell horizontal rotary compressor—One oil sump configuration. Raise or maintain the oil level on the pump side and supply oil directly to the pump's internal space without an oil sump in the motor space using the high-performance model of a horizontal rotary compressor b. High-shell horizontal rotary compressor—Jet pump approach—A two-oil sump configuration in a high-shell rotary compressor with a separator between the motor space and the pump space to induce slight pressure differential between the motor space and the pump space. This uses a jet pump actuated by the discharge gas but without their disadvantages of insufficient motor cooling or undesirable heating of the compressor pump to raise the oil level on the pump space higher than that of the motor space to ensure oil intake port on the outboard flange nose or the end of the oil tube extending from the flange nose is submerged in oil at higher tilt angles. Optional oil supply tube and pressure equalization tube which can be extended to satisfy the operational requirement. For example, the oil tube can end at the mid span of the motor so that the pitch angle can be extended in both forward and backward directions, or extend all the way toward the end of the motor space for maximum pitch angle capability toward the motor.

c. High shell rotary compressor—a single sump approach. A separator between the motor space and pump space that acts as an oil dam. Oil sump only in motor space. Direct oil feed to the pump. For example, the oil tube can end at the mid span of the motor so that the pitch angle can be extended in both forward and backward directions, or extend all the way toward the end of the motor space for maximum pitch angle capability toward the motor.

d. Shell geometric solutions: "Puffer fish" shell design will give "buffer" for oil supplies in cases of short term and/or rapid extreme tilting in addition to slightly increased tiltability.

e. Valve solution: the intake tube can be fitted with valves that get activated by gravity or by electronic means according to the pitch and roll angle with respect to the horizontal axis of the pump.

a. High-Shell/Low-Shell Design:

FIG. 4 shows the schematic of the one of the embodiments. Its shell is divided into two sections by a pressure sealing separator (37) attached to the upper flange 38 of the pump as shown in FIG. 4 and sealed around the perimeter and the shaft of the pump, creating two independently controlled pressure zones within a single shell. One space of the shell containing the main body of the pump has the only oil sump 18 within a much shorter axial length which is favorable to maintain high oil level for a given oil charge and maintained at discharge pressure. The other space contains no oil sump but the drive shaft of the pump to which the rotor of the motor is connected and the and stator of the motor maintained at relatively low pressure such as near suction pressure. In this design, as a means of drastically lowering the motor operating temperature and thus significantly increasing the efficiency of the motor and the isentropic efficiency of the compressor, the cooling medium for the motor is not the high temperature discharge gas with poor heat transfer but low enthalpy liquid refrigerant coming from condenser that would evaporate with extremely high rate of heat transfer on the motor for maximum performance of the vapor compression system or protection of the motor for high temperature discharge gas system. In this design, the discharge gas comes out of the pump into the pump space and drops most of the oil in the sump at the lower part of the pump space before getting out of the pump space through the discharge valve. Since the oil is contained only in the pump side, the oil sump is confined to the pump space and its length dimension is much shorter and the cross-sectional area is much smaller than that of a conventional horizontal rotary compressor in which the oil sump is spread across the entire length of the horizontal shell. Another innovation in this design is the oil intake port 76 located at the bottommost part of the mid plate 9 and flowing through the passage 78 inside the mid plate and connecting to a ring shaped cavity 77 around the rotating shaft and entering the center cavity of the shaft through access holes 79 on the wall of the shaft 3 as shown in FIG. 4. This is in lieu of the traditional way of introducing the oil to the intake port at the end of the outboard flange with a tube attached in a horizontal compressor. Because of the much smaller oil sump cross-section area and the proximity of the intake port to the bottom of the sump, and the fact that the bottom of the sump is rounded as opposed to a flat surface of a vertical compressor, maintaining a proper oil sump level in various tilt angle gets much easier exceeding the tiltability of a vertical compressor, and therefore far exceeds the tiltability of conventional horizontal compressors to fit a majority of applications. The design shown in FIG. 4 represents only one of the embodiments of the High-shell/Low-shell Horizontal Rotary Compressor configuration and there are many possible variations in terms of other locations of the oil intake port (76) and other design choices. High-shell/Low-shell Horizontal designs will accommodate advanced design features including oil intake tube and gravitationally activated valves to be described below as an add-on in order to improve the tiltability much further including the capability of operating 90 degrees up or down from the nominally horizontal orientation. The High-shell/Low-shell Horizontal compressor would be for high end applications demanding highest performance rotary compressors in terms of COP, SEER, and/or high discharge temperature with a respectable degree of tiltability similar to or exceeding that of the vertical rotary compressor, and for maximum tiltability with add-on features.

b. High-shell horizontal rotary compressor-Jet pump approach: This configuration is based on a high-shell compressor design, the most prevalent in rotary compressors in use now for both vertical and horizontal models. FIG. 5 shows the basic schematic of the design with an extra storage for oil sump by expanding the bottom of the oil sump to look like "puffer fish" seen from the righthand side. FIG. 5 uses a particular version of twin cylinder rotary compressor for illustration but the basic concept can be used in other roller piston/vane type rotary compressors. The major components are the pump 1, motor 2, and shell 3. The pump 1 has outboard flange 4, motor side flange 5, and a mid-plate 6 and the drive shaft 7 which is attached to the iron core 8 of rotor 9 of the motor 2, while the stator 10 of the motor 2 is supported by a stator holder 11 which is attached to the motor side flange 5 but not to the shell 3. The low-pressure gas goes into the pump chambers through a suction port (not shown) of the pump to be compressed inside the compression chamber (not shown) and gets discharged into the interior of the shell through a discharge valve 12 toward the pump side of the surface of the motor 2. Most of the discharge gas then flows through the motor in the annular gap as indicated by dotted arrows 13 taking away the heat generated by the motor 2.

Before exiting the shell 3 through the discharge tube 14, most of oil contained in the discharge gas drops to the bottom of the shell 3 where it forms an oil sump 15 in the motor space 16 and oil sump 17 in the expanded "puffer fish" shaped shell of pump space 18.

The separator 6 as shown in FIG. 5 is an extension of the mid plate between the motor space and the pump space as shown. Note that a separator can be attached to or extended part of the outboard flange 4, mid plate 6 as shown here or motor side flange 5. However, unlike the High/Low pressure shell configuration described previously where the separator is pressure-sealing, there are two open flow passages in the separator 6 between the two sides of the separator: Gas Passage 18 in the upper part of the separator 6 for gas flow from the pump space 18 to the motor space 16 and the oil passage 19 near the bottom of the separator 6 for the oil and refrigerant mixture to flow from the oil sump 15 in the motor space 16 to the oil sump 17 in the pump space 18 as shown in FIG. 5. Because of the two passages 18 and 19, the pressures of the two spaces are almost the same as the discharge pressure except for a slight pressure difference generated between the motor space 16 and the pump space 18 due to flows of gas and oil between the two spaces through the two open passages 18 and 19 all powered by the gas tube 20 acting as jet pump by ending near the entrance to the discharge tube 14 to draw the refrigerant gas out of the pump space 18, lowering the pressure in the pump space 18 with respect to the pressure in the motor space 16, causing the oil in the sump 15 to be sucked into the sump 17 in the pump space 18 through the gas passage 18. There is an optional oil tube 21 attached to the oil passage 19 in the lower part of the separator 6 and ending in the mid-point of the motor 2 as shown in FIG. 5.

Going back to FIG. 5, the oil flow is depicted by solid arrows 21 and subsequent arrows going through the oil tube 22 and into the oil sump 17 in the pump space 18. Note that the new configuration is quite different in its flow paths from those of the above three cited U.S. Pat. Nos. 5,012,896, 5,222,885 and 7,040,840, where the pressure difference between the two sides of the separator is generated because the discharge gas impinges on the bottom of the motor but does not flow through the motor and immediately flows out of the motor space and goes back into the pump space to exit into the discharge tube in the pump side. The pressure-drop going through the gas passage acting as an orifice results in pressure drop causing the pressure inside the pump space to go down slightly. However, it is the very fact that the discharge gas flows from the motor space back to pump space prematurely without taking sufficient heat from the motor that the above cited three US patents are not technically tenable or viable. These diverted flow paths for the discharge gas just cannot provide sufficient motor cooling due to premature rerouting of the discharge gas away from the motor. The new configuration provides sufficient motor cooling by placing the discharge tube after the discharge gas goes through the motor and forcing substantial portion of the discharge gas to flow through the gap between the rotor and stator of the motor providing sufficient motor cooling and then exiting the shell on the motor side after exiting the motor. In addition, since the discharge gas does not come into much contact with the pump as would happen with the configurations in the same three cited US patents, the hot discharge gas now further heated up by the motor heat does not heat up the pump either which would be quite detrimental to performance as explained previously for the above cited three US patents. In the proposed configuration, instead, there is a gas tube 20 whose outlet end tip is almost jutting into the discharge tube inlet from the motor side of the shell as shown in FIG. 5 to form a jet pump and the inlet end is sealingly attached to the gas passage 18 of separator 6. When discharge gas flows out of the motor and into the discharge tube, this gas tube 20 acts as a jet pump and evacuate the refrigerant vapor from the pump side, and causes the pressure inside the pump space drop slightly. This slight drop in pressure of the pump space compared to the motor space causes the oil from sump 13 in the motor side 14 to flow into the sump 15 in the pump space 16 until the pumping force due to pressure difference is balanced by the gravitation force exerted by the higher oil level of sump 15 in the pump side 16. The pump space oil sump 15 is exactly the place you would like to have a higher level of oil to ensure proper lubrication and sealing inside the pump with or without the optional oil tube 22 shown in FIG. 5. In short, in this new high-shell configuration of the horizontal rotary compressor, the motor gets cooled by the full discharge flow and the oil is pumped by the pressure difference between the lower pressure in the pump space created by the jet pump which is created by the discharge gas leaving the shell on the motor side and the higher pressure in the motor space into which the discharge gas enters from the compressor pump and leaves the shell out of. Let us think of an operational scenario when the compressor is pitched toward the motor end so that the motor side is much lower than the pump side. This is the scenario that is more difficult to handle than pitching in the other direction. In order to increase the maximum operational pitch angle further, instead of a simple oil passage opening at the bottom of the partition, an optional oil tube can be attached between the lower part of the motor space and the lower part of the partition as shown in FIG. 5. This oil tube can be located inside the shell as shown in FIG. 5 or outside the shell which is not shown. The oil tube should be long enough and its intake end would be preferably positioned roughly around the middle point along the axial length of the stator as shown in FIG. 5 to give the compressor equal pitch angle in the two opposite directions. The length of the oil tube and the location of the oil intake point at its end will be determined by the maximum allowable pitch angle in both directions at which pitch angle the oil level is high enough to cover the oil intake hole but still below the lowest point of the annular gap between the motor and the stator to prevent oil from entering and interfering with the rotor rotation and adversely affecting the compressor performance.

This is to prevent the situation that the oil level gets high enough to get into the annular gap decreasing the discharge gas flow area in the annular gap, increasing the friction in the motor due to the presence of the oil in the annular gap and foaming up the oil thereby reducing the viscosity, lubricity and increasing the friction, leakage within the pump assembly which will in turn reduce the performance of the compressor in terms of less cooling or heating and higher power consumption. Once the oil gets to the sump in the pump space, an optional oil suction tube is connected to the axial cavity in the crank shaft as was shown in FIG. 5.

As mentioned briefly previously, depending on where the oil tube 21 ends, the operationally allowable pitch angle will change. If it extends all the way toward the end of the motor along the bottom of the shell, it will favor pitching down toward the motor, i.e., clockwise pitch angle operation. If there is a short or no oil tube, it will favor pitching down toward the pump, i.e., counter clockwise pitch angle operation. As a means of keeping the tilt angle (pitch and roll angles) equally in both clockwise and counter clockwise pitch angles, the example shown in FIG. 5 has the oil tube ending at the mid-point of the motor 2.

Figure 6:
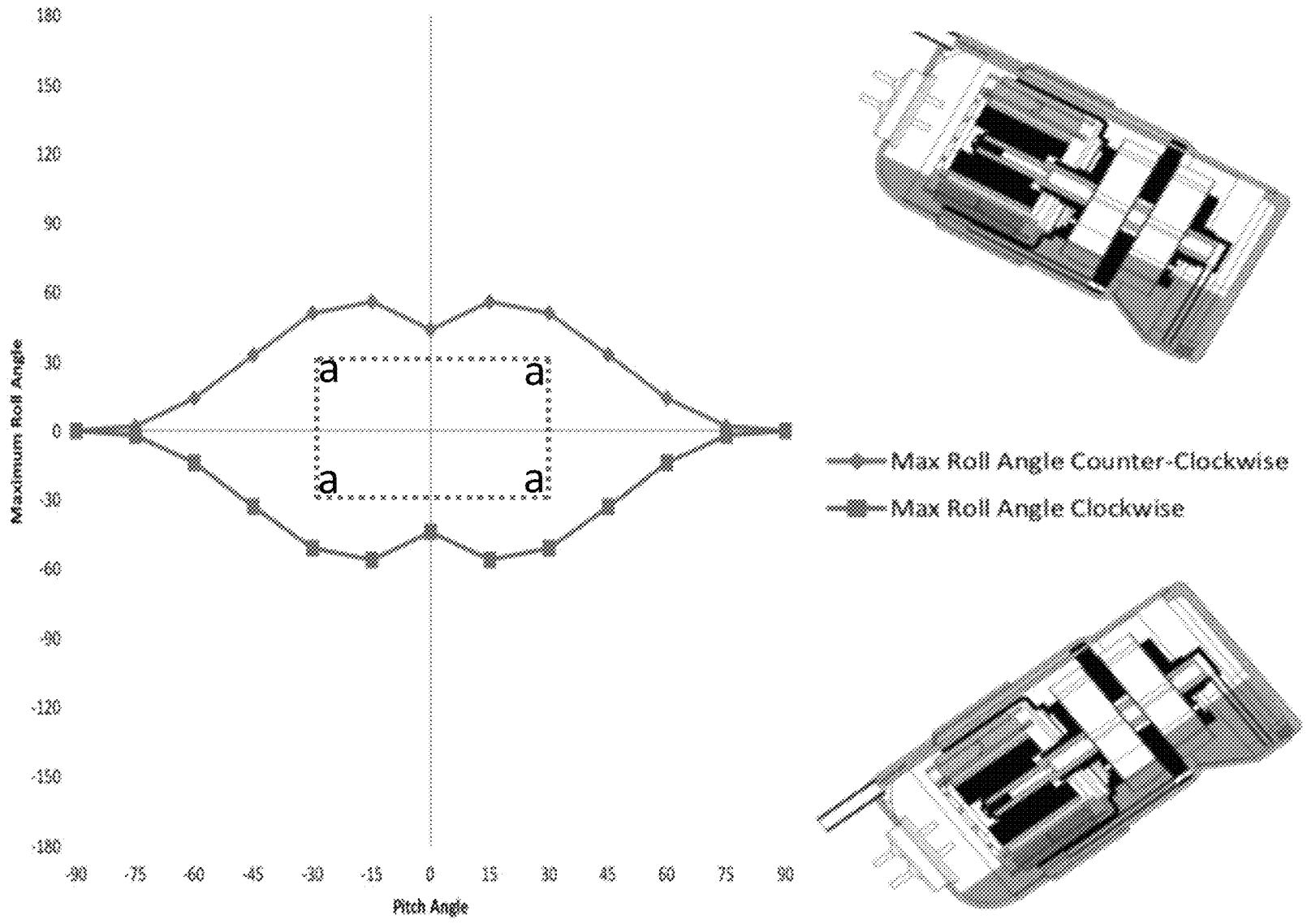
FIG. 6 depicts a chart showing a maximum allowable roll angle as a function of pitch angle for the compressor of FIG. 5.
Figure 8:
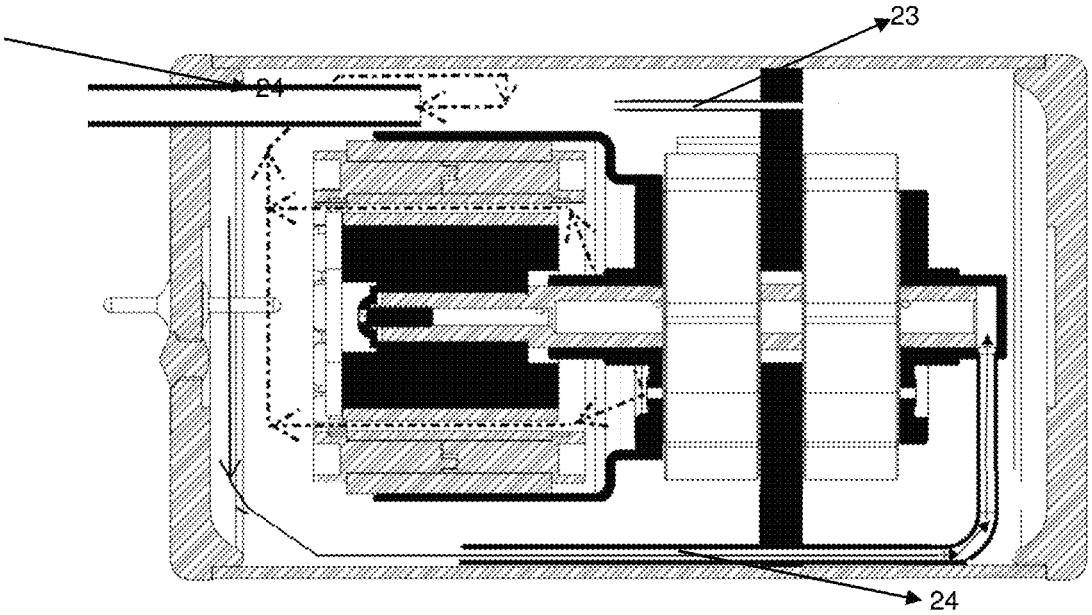
FIG. 8 depicts a schematic of one embodiment of a high-shell rotary compressor with a non-sealing separator, one-oil sump, direct oil connection to an outboard flange in a shell.
Figure 9:
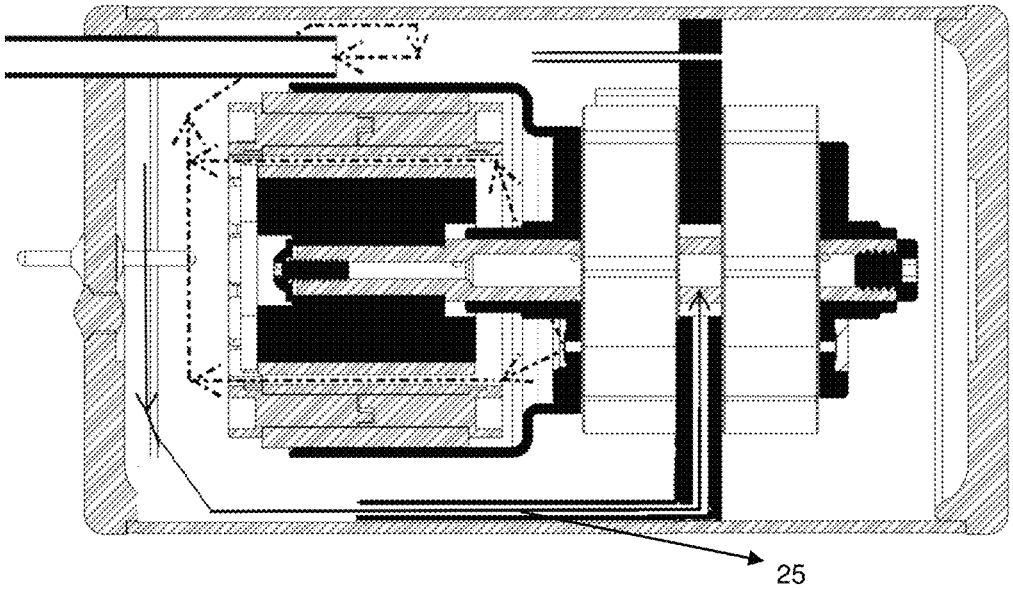
FIG. 9 depicts a schematic of one embodiment of a high-shell rotary compressor with a non-sealing separator, one-oil sump, direct oil connection to the mid plate in a standard shell.
Figure 10:
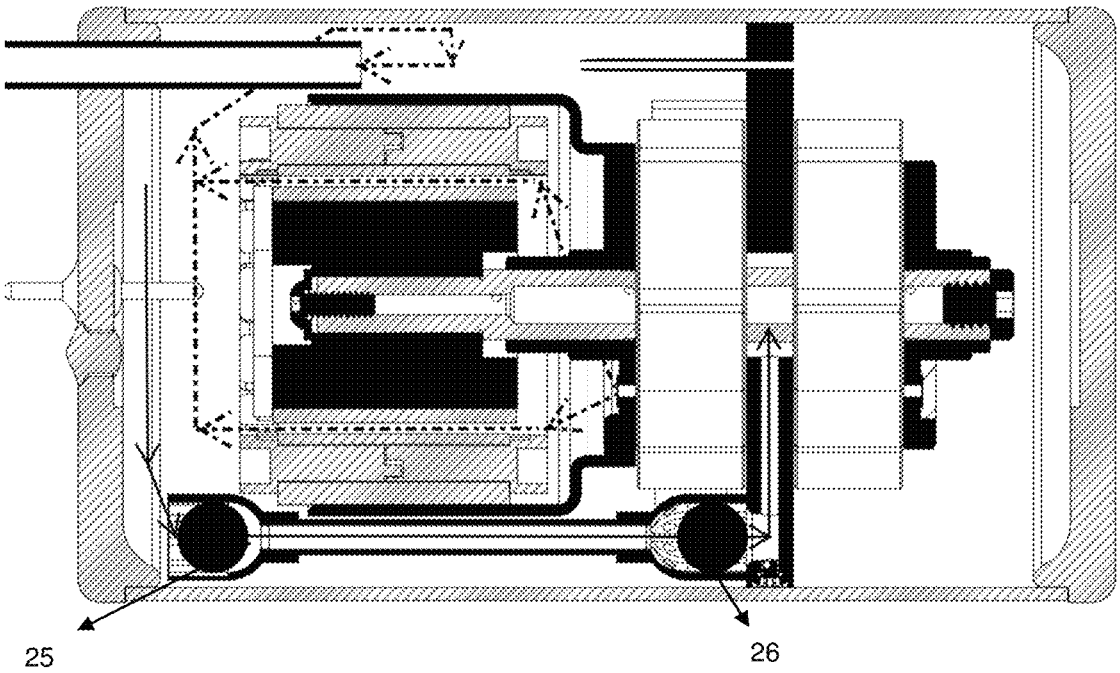
FIG. 10 depicts a schematic of one embodiment of a high-shell rotary compressor in a shell with a non-sealing separator, one-oil sump, direct oil connection to a mid-plate, and oil tube with gravity activated.
Figure 11:
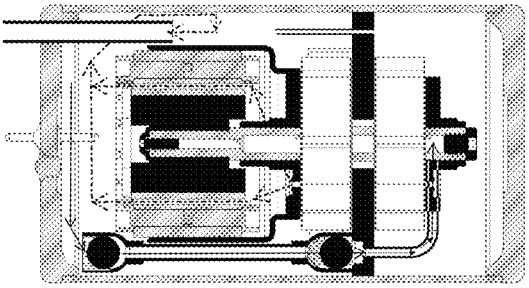
FIG. 11 depicts a schematic of one embodiment of a high-shell rotary compressor in a shell with a non-sealing separator, one-oil sump, direct oil connection to an outboard flange plate and to a flange nose.
Figure 12:
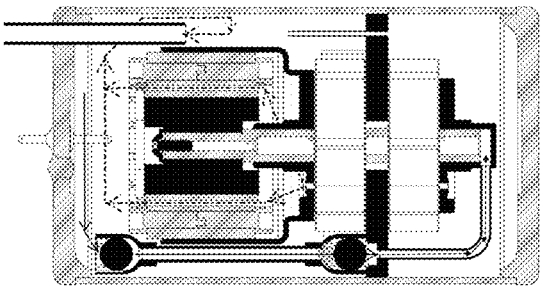
FIG. 12 depicts a schematic of one embodiment of a high-shell rotary compressor in a shell with a non-sealing separator, one-oil sump, direct oil connection to an outboard flange plate and to an oil tube with gravity activated valves.

FIG. 6 and FIG. 7 show some details of tiltability which is defined herein as the capability of a compressor to operate with no performance degradation off its nominal orientation in pitch angle and roll angle of the compressor shown in FIG. 5. It shows a markedly improved tiltability over that of a conventional vertical rotary compressor which has the tiltability of 30-degree solid angle off the vertical direction and represented as the dotted rectangle a-a-a-a. This horizontal configuration will definitely satisfy vast majority of mobile as well has stationary applications with the exception of nearly upside-down operation for special applications.

c. High shell rotary compressor—a single sump approach: This configuration is also for a high-shell horizontal rotary compressor as shown in FIGS. 6 and 7. There is a separator between the motor space and the pump space as above but there is no jet pump and there is an oil pump in the motor space but no oil sump in the pump space. The separator has two holes: one at the bottom is the passage for the oil from the sump in the lower part of the motor space with a sealed connection to the central cavity of the shaft, and the hole at the top is mainly for pressure equalization between the motor space and the pump space. In this configuration, there is no pressure differential between the two spaces to raise an oil level in the pump space because there is no oil sump there. Instead, the separator simply acts as an oil dam limiting the span of the oil sump in the motor space so that the oil sump height is higher than without the oil dam between the two spaces. The oil can flow from the sump to the internal parts of the pump through a suction tube extended from the separator and connected to the nose of the flange either axially or radially, to the mid plate or flange plate itself with or without an oil suction tube as shown in FIGS. 8 and 9. Instead of the venturi tube, there is a pressure equalizing tube 23 extending axially from the "top" of the separator to the mid-point of the motor. The function of the pressure equalizing tube is to equalize the pressure of the motor space and the pump space and to drain any oil slowly leaking from the pump through the back of the vane slot during maintenance. Or, if the back of the vane is closed off to prevent oil leak into the pump space, the function of the tube is just to equalize the pressure of the motor space and the pump space but in such a case there will be no oil to drain from the motor space during maintenance. Because the oil is fed directly to the pump, there is no oil sump in the pump section and the oil will flow from the oil sump through the oil tube 24 or 25 to the central cavity of the shaft.

d. Shell geometric solutions: "Puffer fish" gives "buffer" for oil supplies in cases of short term and/or rapid extreme tilting in addition to slightly increased tiltability. One can also have the optional "puffer fish" bulge at the bottom of the oil sump 17 as was shown in FIG. 5. When the valve closes, the pump assembly will still draw in the oil until the oil sump drops to the lowest level. At the point, the oil that was drained away will have filled up the oil level in the motor space enough to go above the oil passage and the oil will start flowing again. The maximum angle that this occurs depending on the size of the oil sump that was increased by the "puffer fish" design and effectiveness of the low-pressure check valve to prevent back flow when the oil passage gets exposed temporarily.

e. Valve Solution:

This is to increase the tilt angle even further for special high tilt applications. This configuration utilizes an oil intake tube with one or two gravity, piezo-electrically or electro-mechanically actuated flow control valves to draw the oil from the sump in the correct direction. If it is done electrically, one can envision a control valve located right before the partition: open to the entire length of the tube allowing the oil to be sucked up from the end of the tube, closed to the entire length of the tube but open to the oil port near the partition within the motor space. In FIGS. 10, 11, and 12, the two gravity activated valves are added: the first valve is shaped like a ball valve in a socket and attached to the end of the oil pick up tube. The other similar gravity actuated valve is located right before the oil intake tube attaches to the partition and used to cover or expose the underside of the oil intake tube. When the horizontal compressor is operating horizontally, the oil will enter the tube and flow through either or both valves that are open. When the pitch angle is such that the motor side is raised up and the pump side lowered, the gravity actuated valve at the tip of the oil tube is closed on the end of oil intake tube to prevent refrigerant vapor from getting sucked into the oil intake tube creating a vapor lock. At the same time, the gravity actuated valve attached near the oil access hole of the separator inside the tube opens in front of the separator allowing the pool of oil to get into the oil intake tube pumping the oil into the oil sump in the pump space or directly into the pump part as shown in FIGS. 10, 11, and 12 for higher level of tiltability. When the pitch angle is such that the motor side is lowered and the pump side raised up, the gravity actuated valve near the end of the oil intake tube is wide open and the other valve is closed by gravity to prevent refrigerant vapor from getting sucked into the oil intake tube. Even though the valve near the separator is closed, there is a passage through which oil will flow around the ball valve within the intake tube so that the oil being pushed up through the oil tube goes into the oil sump in the pump space or directly into pump parts as shown in FIG. 10, 11, or 12 for higher level of tiltability.

Figure 13:
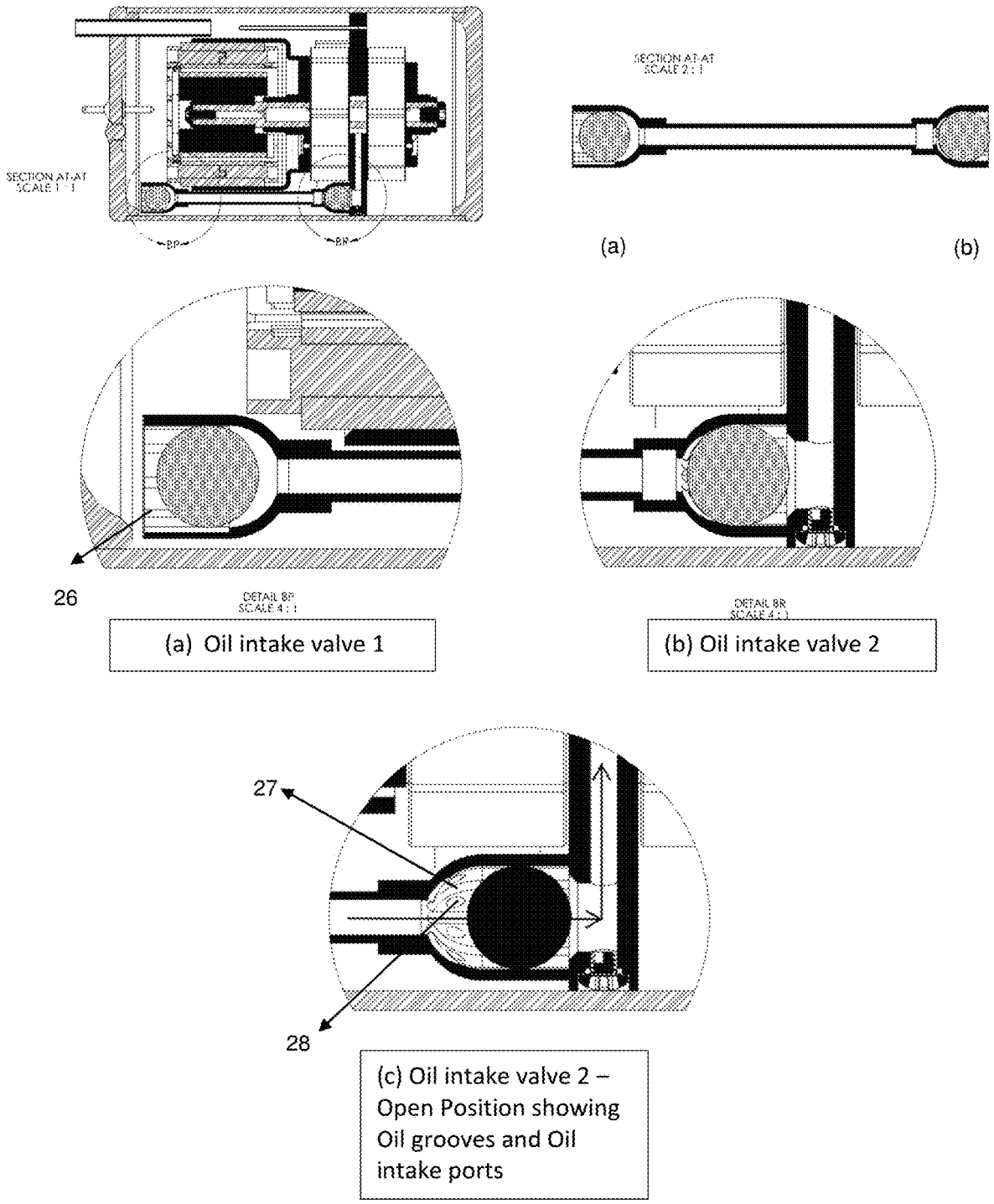
FIG. 13 depicts a schematic of a high-shell rotary compressor in a shell with a non-sealing separator, one-oil sump, direct oil connection to the mid plate, and oil tube with gravity activated valves.
Figure 14:
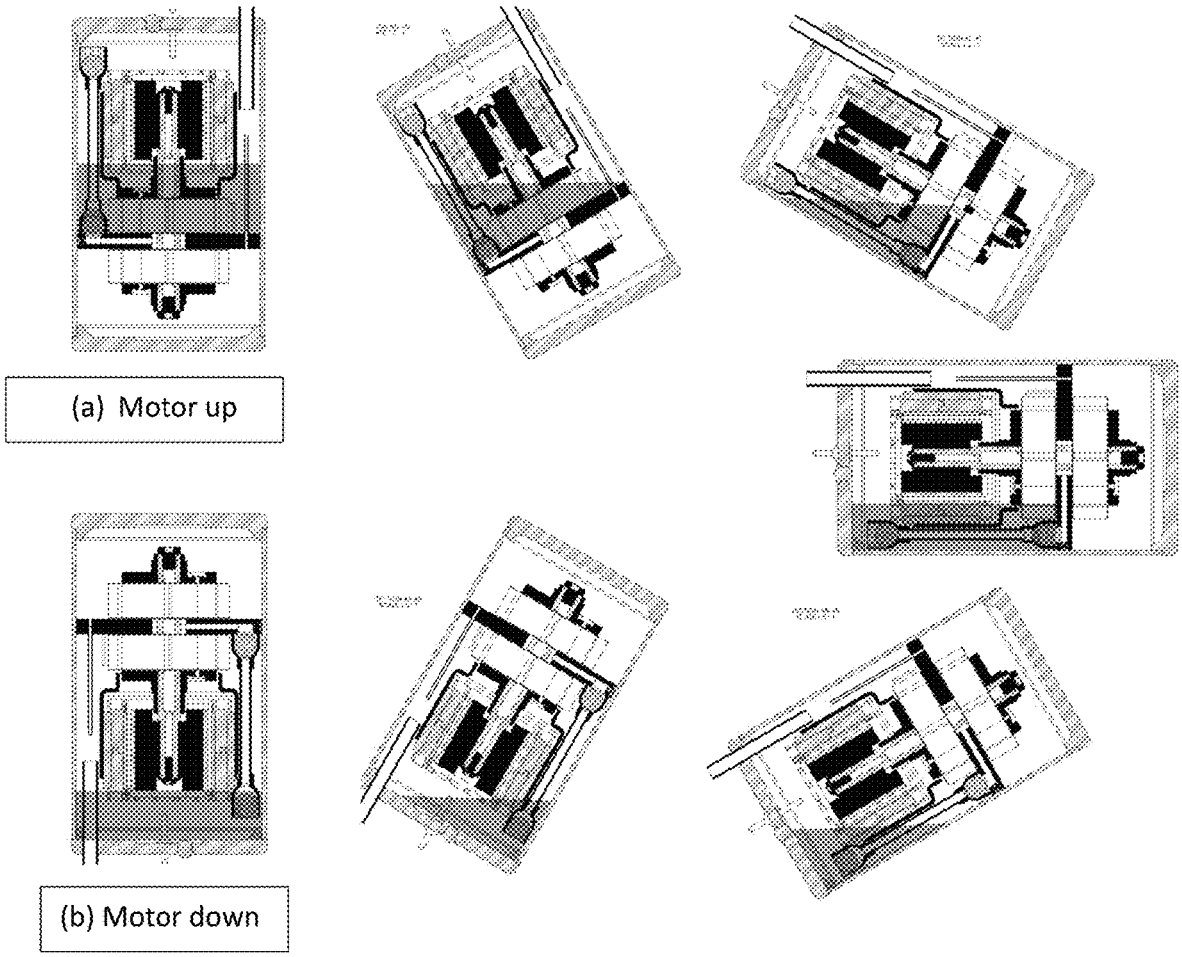
FIG. 14 depicts an illustration of the oil supply for the horizontal rotary compressor of FIG. 13 with gravity activated valves for tiltability at various orientations.

The shape of the gravity actuated valves can have many configurations. It can be a trap door on a hinge or a ball valve in a contoured socket. In both cases, the gravity will cause the trap door or the ball valve open or close. The design details involving a spherical ball and a contoured funnel as a valve and valve seat is shown in FIGS. 13 and 14: the ball valve shown on the left (oil intake valve 1) remains open and the ball valve shown on the right (oil intake valve 2) remains closed when the pitch angle is less than 0 degrees, meaning the motor side is lower than the pump side. This continues until the pitch angle becomes 0 degrees and at that position both balls will roll out of the funnel shaped valve seats opening both valves meaning that oil from the sump will flow in from both valves. As shown in FIG. 13, The oil intake valve 1 has grooves 26 on the inside of the cylindrical section that allows the oil flow in the grooves past the ball when the ball is out of the seat but when the oil valve 1 is closed, there will be no flow of oil or gas into the oil tube, whereas the oil intake valve 2 has grooves on the cylindrical portion that opens up to the oil supply channel to the pump's interior (in this case to the oil passage in the mid plate).

The oil intake valve 2 has two paths for the oil: one is internal path/grooves 27 for the oil that allows the flow of oil coming through the oil intake valve 1 whether the oil intake valve 2 is open or closed. The other is a set of ports 28 to communicate with the oil sump outside the tube and when the ball is in the "socket", the port to the sump is closed and when the ball is out of the spherical socket and in the cylindrical section, the oil intake port 2 opens letting in oil from the sump into the oil tube, flowing in the grooves past the ball and into the mid plate and to the internal pump parts.

When the motor side is pointing down vertically and the pump side is pointing up. The ball valve (FIG. 13(*b*) near the separator (Oil intake valve 2) is closed to the gas because the ball fell into the spherical valve seat to the gas but the internal oil flow path through the grooves is open, and oil intake valve 1 at the end of the oil intake tube is open to allow the oil to flow up in the oil tube and flow past the closed oil intake valve 2 near the separator through the grooves in the cylinder that is partially blocked by the ball except for the grooves. The closed oil intake port on the top valve prevents refrigerant vapor from getting into the oil supply that may create a vapor lock.

When the motor side is on top and the pump side is at the bottom, the oil intake valve 1 is closed because the ball dropped into the spherical valve seat and the closed valve prevents any refrigerant vapor from coming in that may create vapor lock. In the meantime, the oil intake valve 2 (FIG. 13(*a*)) is open because the ball dropped out of the spherical valve seat to open the oil intake port and the oil from oil sump now located on top of the separator as shown in FIG. 14(*b*) flows into the oil tube, flows past the ball through the grooves and into the mid plate and to the internal pump parts.

Figure 15:
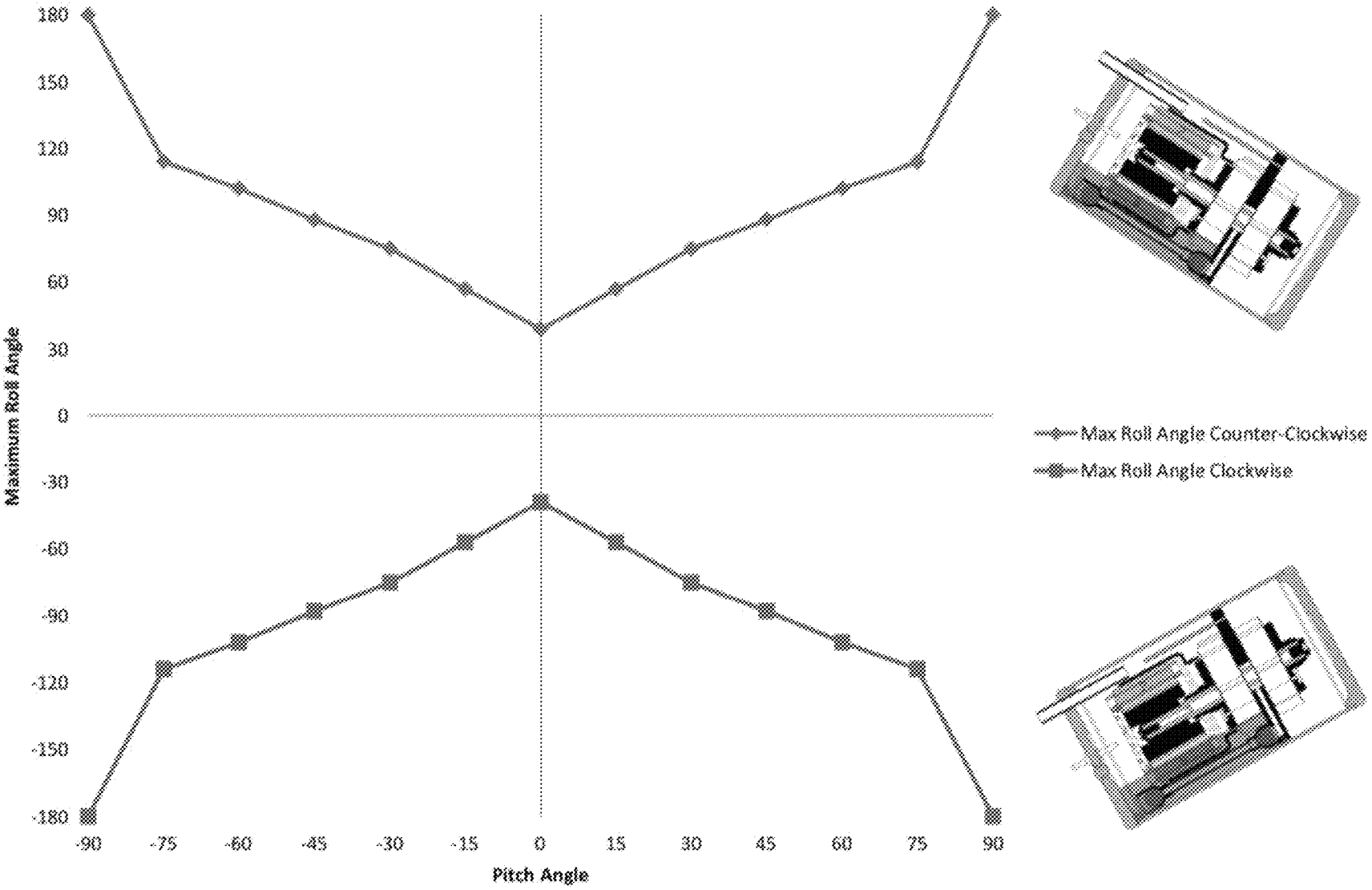
FIG. 15 depicts a chart of maximum allowable roll angles as a function of pitch angle for a horizontal compressor with gravity actuated valves.

This configuration enables operation of the horizontal compressor in any pitch angle even though the allowable roll angle varies as a function of the pitch angle as shown in FIG. 15.

Comparison of Tiltability of Various Configurations

Figure 16:
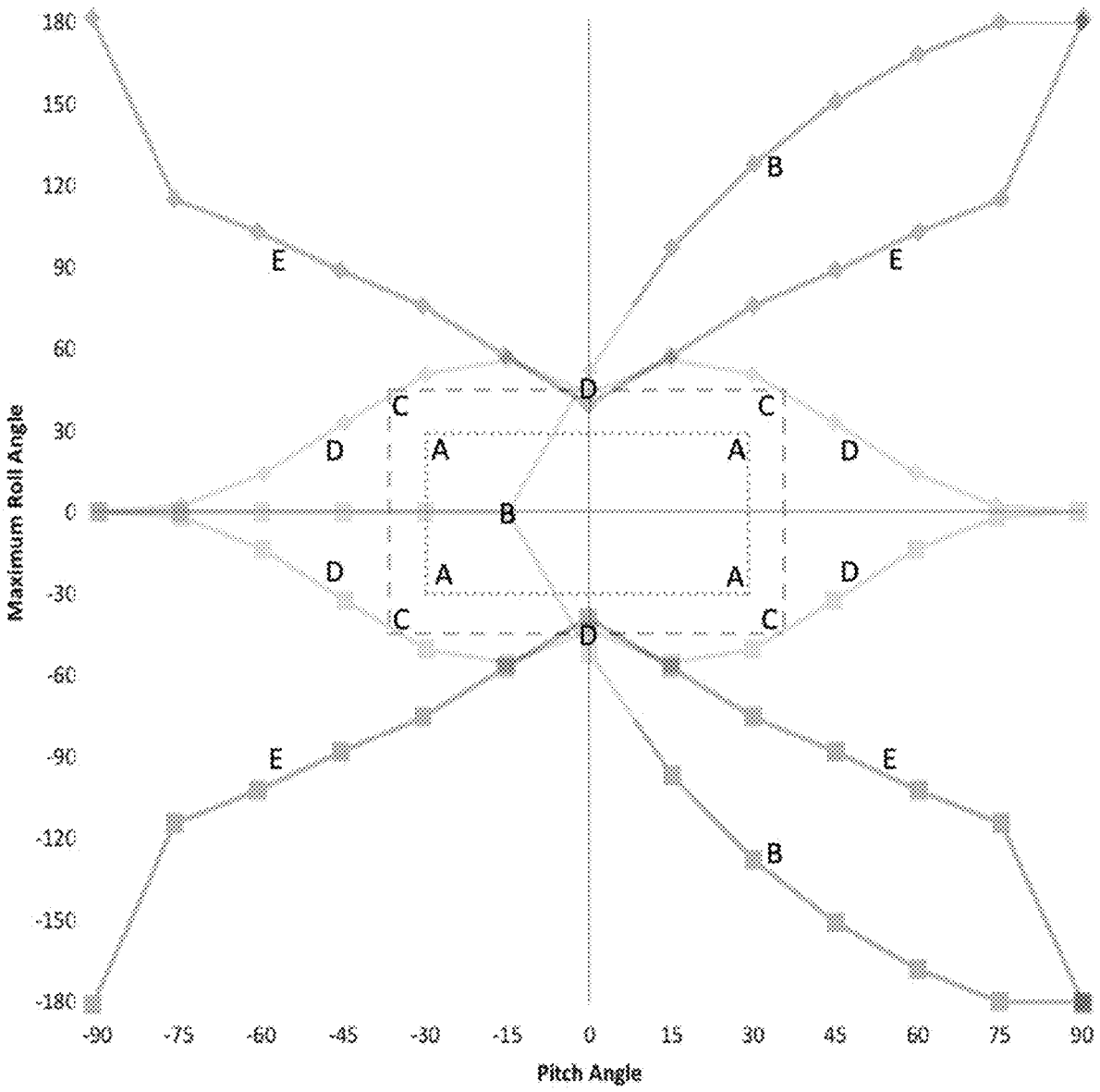
FIG. 16 depicts a chart showing a comparison of tiltability of various rotary compressor configurations.
Figure 17:
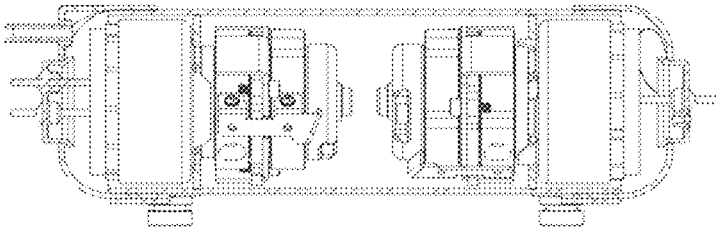
FIG. 17 depicts one embodiment of a high/low shell horizontal compressor with two pumps facing one another without a separating wall in a rounded shell.
Figure 18:
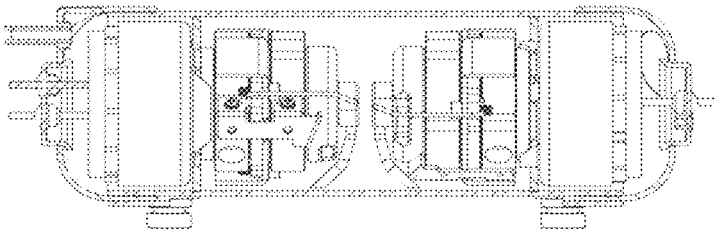
FIG. 18 depicts another embodiment of a high/low shell horizontal compressor with two pumps facing one another without a separating wall in a rounded shell.
Figure 19:
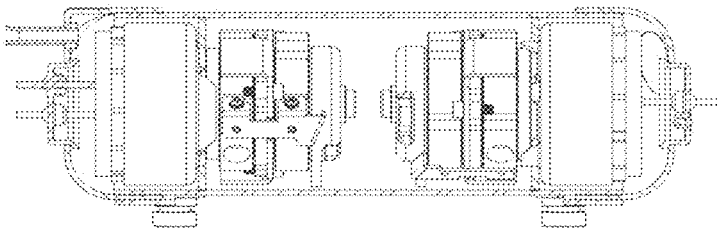
FIG. 19 depicts another embodiment of a high/low shell horizontal compressor with two pumps facing one another without a separating wall in a rounded shell.
Figure 20:
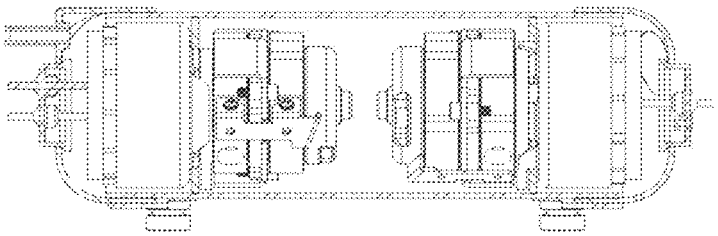
FIG. 20 depicts another embodiment of a high/low shell horizontal compressor with two pumps facing one another without a separating wall in a rounded shell.
Figure 21:
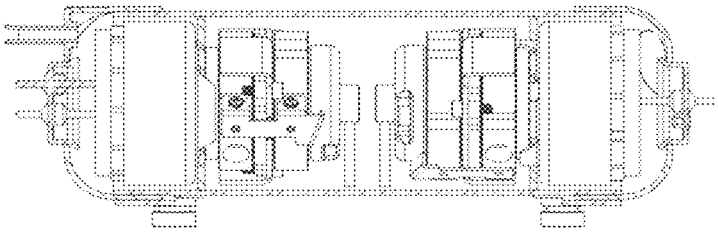
FIG. 21 depicts another embodiment of a high/low shell horizontal compressor with two pumps facing one another without a separating wall in a rounded shell.

FIG. 16 shows comparisons of estimated tiltability for five different configurations described above: vertical rotary compressor (A), conventional horizontal rotary compressor (B), high-shell/low shell rotary compressor without any further tiltability enhancements (C), high shell horizontal rotary compressor with oil supply tube and jet pump (D), high shell horizontal rotary compressor with valves and oil supply tube (E).

A state-of-the-art vertical rotary compressor has a tiltability (capability to operate at the angle off its nominal orientation in terms of pitch and roll angle off the nominally horizontal orientation) of 30 degree solid angle as denoted by the rectangle A. The currently available horizontal rotary compressor denoted by the near parabolic curve B has an excellent tiltability when the compressor is pitched in the positive angle, i.e., the pump side is lower than the motor side giving more than sufficient roll capability to satisfy most applications. However, when the pitch angle reverses and the pump side is higher than the motor side, oil rapidly drains toward the motor side of the sump depriving the oil from the pump. Therefore, the conventional horizontal compressor is not suitable for any mobile applications or stationary applications where the operational orientation is such that the pump side is slightly higher than the motor side. The high-shell/low-shell horizontal rotary compressor configuration of FIG. 4, denoted by a rectangle C, exhibits higher tiltability than a vertical compressor due to the fact that the effective cross sectional area of the oil sump is much smaller than that of a vertical compressor and also due to the fact that the bottom of the oil sump is curved in contrast to a more flat bottom of a vertical compressor. The tiltability of this compressor will increase further if the other tiltability enhancement features such as oil tube with or without the gravity actuated valves are incorporated into the high-shell/low-shell design. The "human lip" shaped curves identified by D is for the configuration shown in FIG. 5 with the jet pump enhancement or for a high-shell horizontal rotary compressor with a single sump and direct oil connection to the pump without needing another sump in the pump space as illustrated in FIGS. 8 and 9 and without the jet pump assist. The two "sand clock" shaped curves marked by E shaped curves represent the tiltability of horizontal compressors equipped with the valves in the oil tube, either depicted in FIGS. 10, 11, 12, and 13 for high-shell horizontal compressors or with a modification to the high-shell/low-shell horizontal rotary compressor shown in FIG. 4 to include the oil tube and the valves. These maximum tilt capable horizontal compressors will be suitable for extreme tilt applications such as fighter jets, helicopters, drones, rockets, missiles, laser projection systems, etc. where the tilt angles will vary widely during operation.

Brief Discussion on the Applicability of the Above Features to Scroll Compressors Even though description of tiltabilty enhancement so far has been limited to roller-piston/vane type compressors such as rolling piston compressor, concentric vane compressor and swing compressor, similar/equivalent arrangements can be made to make scroll compressors more tilt tolerant during operation. The difference will be the geometry of oil supply route from the outside the pump set to the inside of the scroll compressor's pump assembly.

Enhanced Reliability, Redundancy, High Turn-Down Ratio with Nearly Constant Efficiency, and Increased Capacity with the Same Low Height of the Compressor and Vapor Compression System It is quite desirable to have a cooling system that has high cooling efficiency over a wide range of cooling capacity, and maintain high efficiency over a high turn down ratio so that the cooling system does not have to be turned on and off frequently to maintain a set temperature within prescribed limits.

It is also very desirable to have extraordinarily high reliability of the cooling system than current vapor compression systems based on commercially available vertical or horizontal rotary compressors especially in a distributed cooling or heating systems where the system failure can be catastrophic to the local system such as a dedicated cooling system inside a server cabinet in a data center or military systems. Most of the rotary compressors have efficiencies that start low at low speed, goes highest at a medium speed and decreases as speed increases to its maximum while the turn down ratios are generally less than 5 even for the best variable-speed-compressor based systems. The reliability desired/required in a distributed cooling system for a server rack or a dedicated system for communication can be much higher than what the vapor compression system and refrigerant compressor industries can deliver in an affordable manner unless two independent cooling systems are used.

In short, the deficiencies of the currently available refrigeration compressors in general, vertical or horizontal, are: height of the vertical compressor may be too tall for a low headroom cooling system such as 2U compatible cooling system; tiltability is limited for conventional horizontal compressors, efficiency changes too much over the operating speed range, limited turn down ratio requiring undesirable frequent on-off operation thereby lowering the COP or SEER of the vapor compression system.

Figure 22:
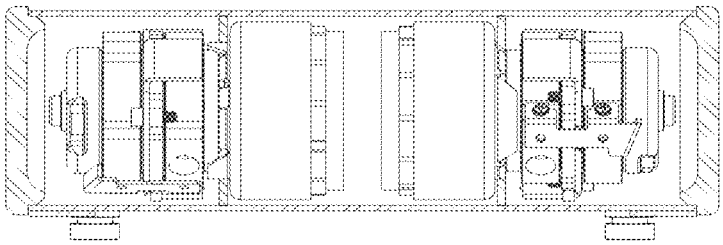
FIG. 22 depicts one embodiment of a high/low shell horizontal compressor with two pumps facing away from each other without a separating wall in a single flat cap shell.
Figure 23:
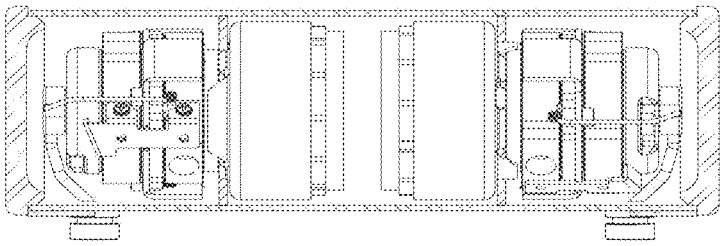
FIG. 23 depicts another embodiment of a high/low shell horizontal compressor with two pumps facing away from each other without a separating wall in a single flat cap shell.
Figure 24:
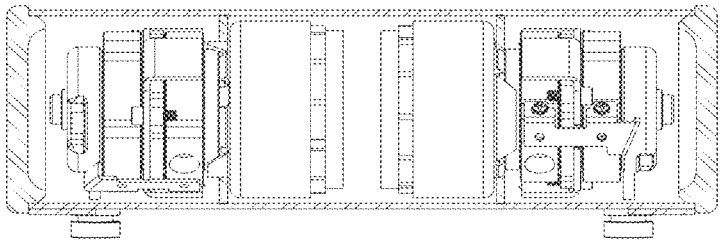
FIG. 24 depicts another embodiment of a high/low shell horizontal compressor with two pumps facing away from each other without a separating wall in a single flat cap shell.
Figure 25:
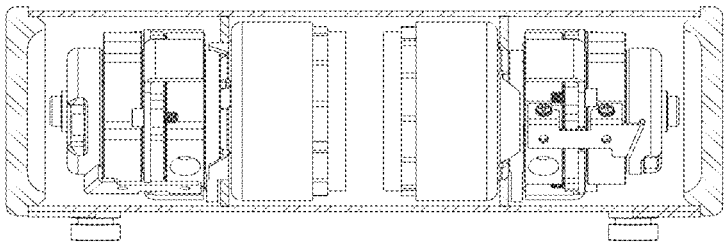
FIG. 25 depicts another embodiment of a high/low shell horizontal compressor with two pumps facing away from each other without a separating wall in a single flat cap shell.
Figure 26:
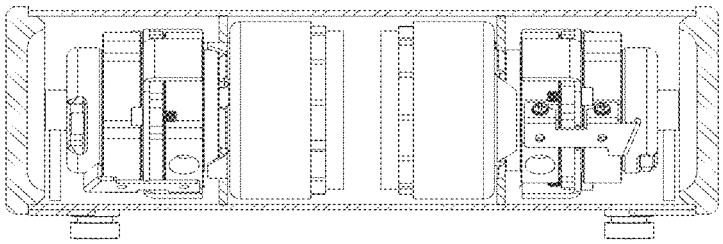
FIG. 26 depicts another embodiment of a high/low shell horizontal compressor with two pumps facing away from each other without a separating wall in a single flat cap shell.
Figure 27:
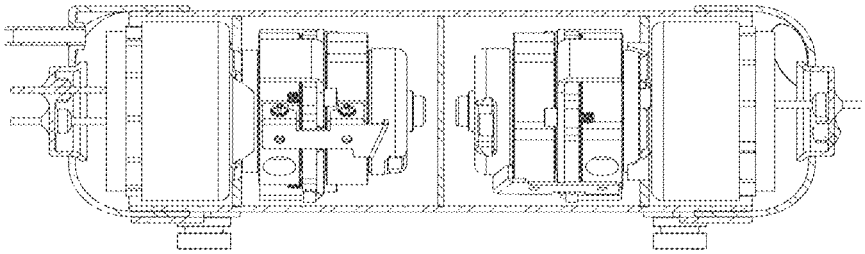
FIG. 27 depicts one embodiment of a high/low shell horizontal compressor with two pumps facing each other with a separating wall in a rounded cap shell.
Figure 28:
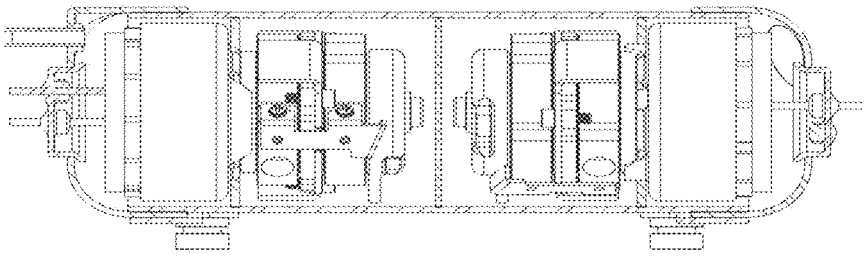
FIG. 28 depicts another embodiment of a high/low shell horizontal compressor with two pumps facing each other with a separating wall in a rounded cap shell.
Figure 29:
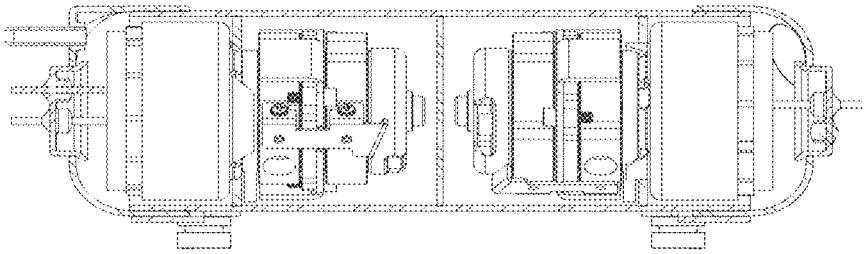
FIG. 29 depicts another embodiment of a high/low shell horizontal compressor with two pumps facing each other with a separating wall in a rounded cap shell.
Figure 30:
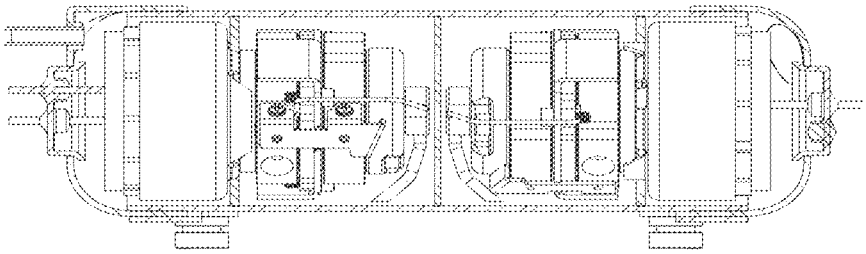
FIG. 30 depicts another embodiment of a high/low shell horizontal compressor with two pumps facing each other with a separating wall in a rounded cap shell.
Figure 31:
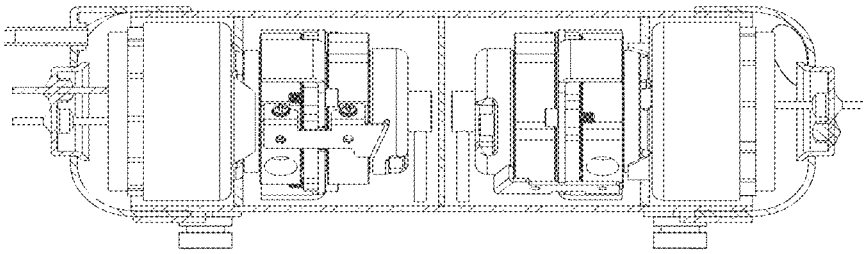
FIG. 31 depicts another embodiment of a high/low shell horizontal compressor with two pumps facing each other with a separating wall in a rounded cap shell.
Figure 32:
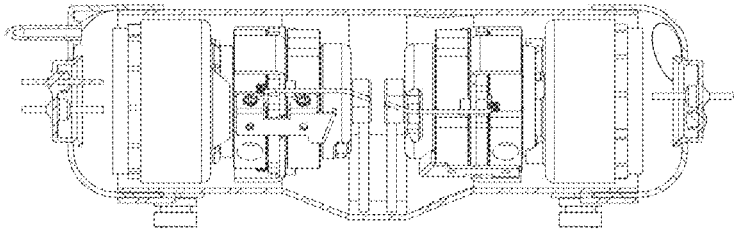
FIG. 32 depicts one embodiment of a high-shell horizontal compressor with two pumps facing each other in a puffer-fish shaped shell.
Figure 33:
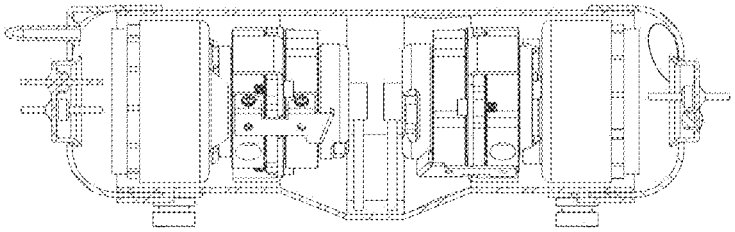
FIG. 33 depicts another embodiment of a high-shell horizontal compressor with two pumps facing each other in a puffer-fish shaped shell.
Figure 34:
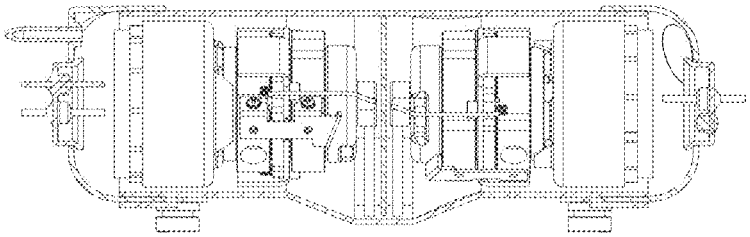
FIG. 34 depicts another embodiment of a high-shell horizontal compressor with two pumps facing each other in a puffer-fish shaped shell.
Figure 35:
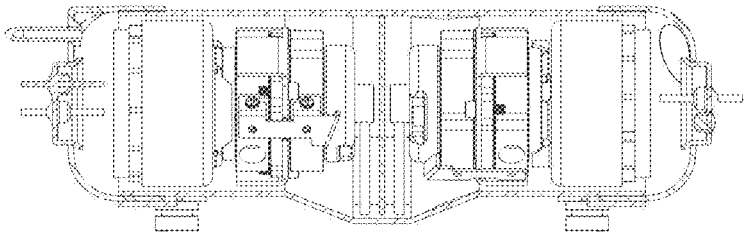
FIG. 35 depicts another embodiment of a high-shell horizontal compressor with two pumps facing each other in a puffer-fish shaped shell.
Figure 36:
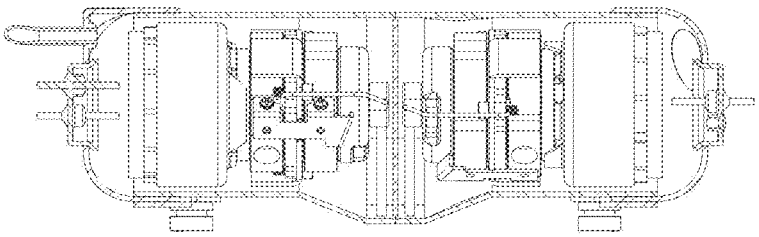
FIG. 36 depicts another embodiment of a high-shell horizontal compressor with two pumps facing each other in a puffer-fish shaped shell.
Figure 37:
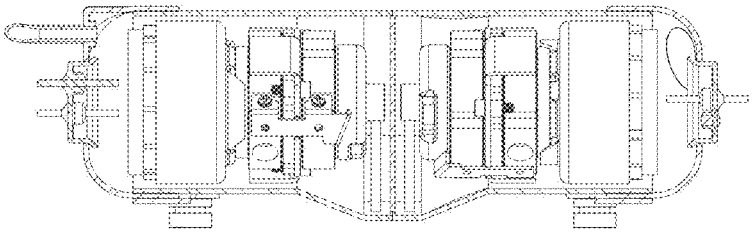
FIG. 37 depicts another embodiment of a high-shell horizontal compressor with two pumps facing each other in a puffer-fish shaped shell.
Figure 38:
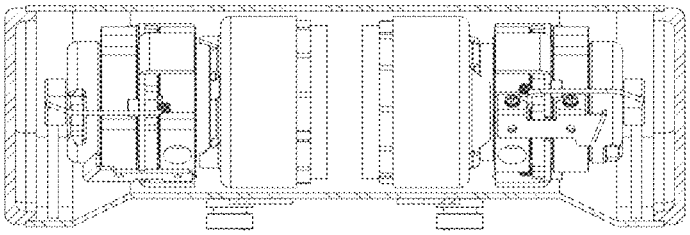
FIG. 38 depicts one embodiment of a high-shell horizontal compressor with two pumps facing away from each other in a puffer-fish shaped shell.
Figure 39:
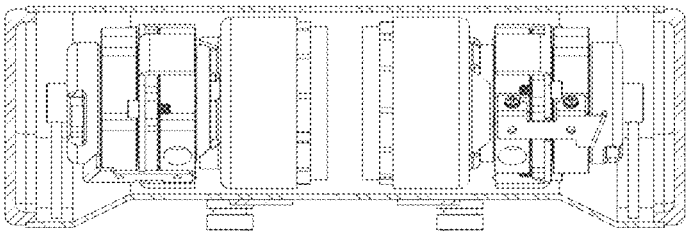
FIG. 39 depicts another embodiment of a high-shell horizontal compressor with two pumps facing away from each other in a puffer-fish shaped shell.
Figure 40:
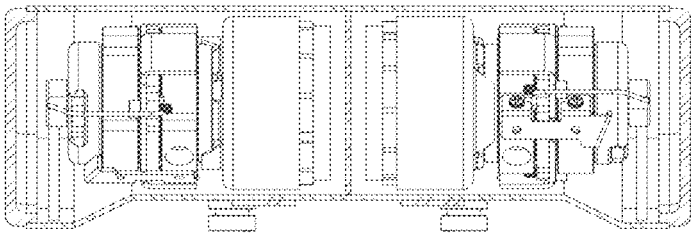
FIG. 40 depicts another embodiment of a high-shell horizontal compressor with two pumps facing away from each other in a puffer-fish shaped shell.
Figure 41:
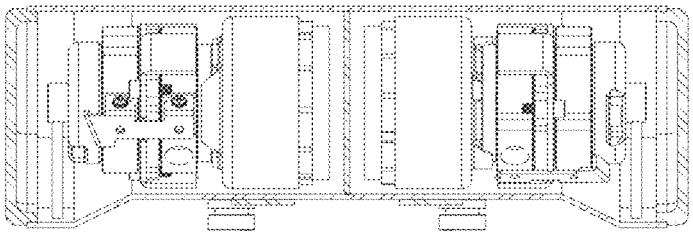
FIG. 41 depicts another embodiment of a high-shell horizontal compressor with two pumps facing away from each other in a puffer-fish shaped shell.
Figure 42:
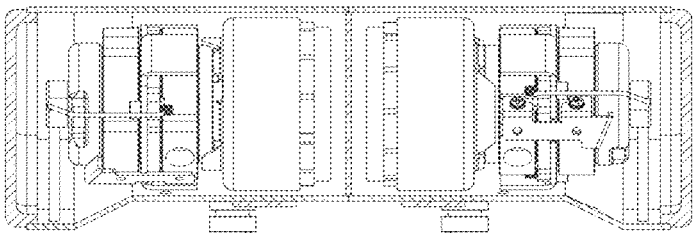
FIG. 42 depicts another embodiment of a high-shell horizontal compressor with two pumps facing away from each other in a puffer-fish shaped shell.
Figure 43:
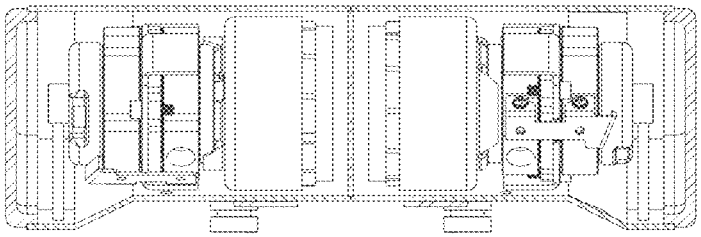
FIG. 43 depicts another embodiment of a high-shell horizontal compressor with two pumps facing away from each other in a puffer-fish shaped shell.

All these concerns can be addressed by having multiple number of pump-motor sets controlled separately by separate BLDC drives within a shell. Two pump-motor sets will enable operating them one at a time, both at the same time at lower speed or operating at different speeds to get optimal performance, etc. all controlled by the controller of the vapor compression system. Because the rest of the vapor compression system may be designed to handle two compressors at maximum speed, when only one is used or both are used at lower speed, the heat exchangers will be oversized and the heat exchanger performance will be excellent and system performance will be high at part load as well as full load over a wide range of cooling capacity. This will also increase the longevity of the pump sets as well as that of the vapor compression system. When one compressor fails for some reason, the other can take over and the controller can detect the failure and notify the system operator to replace the unit. The inherent redundancy of the multi pump-motor-BLDC drive sets within a single shell will significant enhance the reliability of the whole vapor compression system. The multi pump-motor set configuration shown as examples below uses only two identical pump assemblies with independent motor drives inside a single shell laid out in a horizontal orientation. Of course, one can use more than two sets of pump-motor. The two pump/motor assemblies can come in many different configurations depending on the way they are oriented with each other in terms of the pump-motor assembly, whether there is a separator between the two pump-motor assembly, whether the compressor is a high shell or high/low shell compressor, the locations where the oil from the oil sump is taken, and oil level boosting methods such as jet pump, methods of oil supply into the internal moving parts of the pump is either using two sumps or a single sump, etc. Only a subset of representative configurations will be given but this disclosure does not preclude any combinations that are not described explicitly. The pumps shown herein to illustrate various options or variations are all basic twin cylinder pumps. FIGS. 17, 18, 19, 20, and 21 give five different configurations of a horizontal compressor with two pumps facing each other without a separating wall in a single shell. FIGS. 22, 23, 24, 25, and 26 give five different configurations of a horizontal compressor with two pumps facing away from each other toward each end cap. FIG. 22 is uni-direction, or away from each other toward each end cap. In the back-to-back configuration, the motor section of each pump/motor assembly is facing each other near the middle section of the shell and the "the bottom" flange and the oil sump are near each end cap. In the uni-directional configuration, motor sections are facing the same direction and the "bottom" flange and the oil sump of each assembly is also located in the same direction. facing its end cap and the "bottom" flange is toward the middle of the shell where the oil sump is located.

Brief Discussion on the Applicability of the Above Features to Scroll Compressors Even though description of various configurations of multi pump-motor set horizontal compressors so far has been limited to roller-piston/vane type compressors such as rolling piston compressor, concentric vane compressor and swing compressor, similar/equivalent arrangements can be made to make horizontal scroll compressors with multiple pump-motor sets with similar ensuing advantages such as higher capacity, high part load efficiency, reliability, redundancy, etc. The difference will be in the geometry of oil supply route from the outside the pump set to the inside of the scroll compressor's pump assembly.

Examples of Vapor Compression Systems Using the New Horizontal Compressors

Figure 44A:
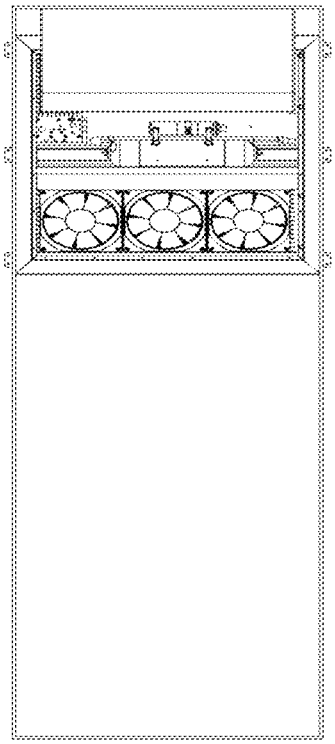
FIGS. 44A-44B depict one embodiment of a low front-to-back depth vertical vapor compression system to cool electronics inside a cabinet with an air cooled condenser showing a horizontal installation of a horizontal compressor.
Figure 44B:
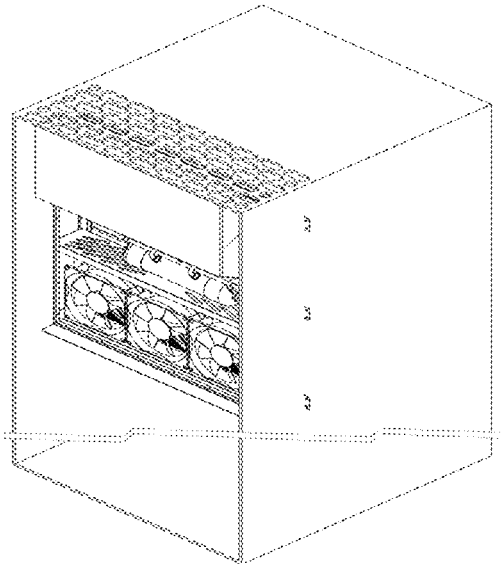

The following examples show, without excluding others, how the new horizontal compressors with many new advantages can be used in new ways that were not possible before:

FIGS. 44A and 44B show a schematic of a vertical HVAC with small back to back dimensions with air cooled condenser exchanging heat with ambient air and exhausting the hot air to the top. This design can be easily changed to use water cooled condenser instead. Also, the HVAC unit can be a horizontal unit with low height taking advantage of the low height of the horizontal compressor such as rack mounted units for server racks or cabinets. For this system, if the application is stationary and requires extremely high energy efficiency over a high turn down ratio with excellent part load performance, reliability and redundancy, one would choose to have a two-pump set, high/low shell horizontal rotary compressor similar to the one described in FIG. 4 with two pump-motor-BLDC drive sets to have the double the capacity that is required. If one pump set fails, the other one will take over to provide perfect redundancy until the unit is replaced. If intended application is for a mobile application, then appropriate features to enhance tiltability described herein will be included in the compressor to an appropriate extent. For example, if it is for providing air conditioning and heating for Electric Vehicles where degree tiltability, very high full and partial load efficiency, large capacity in a low height or low depth design with relatively large cooling capacity, a horizontal rotary compressor with high efficiency features of high-shell/low-shell configuration of FIG. 4, medium tiltability design with jet pump feature similar to the one shown in FIG. 5 combined with the two-pump configuration from one of the two pump-motor configurations described in FIGS. 17-31 would be a perfect fit. If it is to cool communication electronics for military application where tiltability up to 60 degree, high efficiency, large capacity in a low height or low depth design with relatively large cooling capacity, and redundancy are required, a horizontal rotary compressor with high efficiency features of high/low configuration of FIG. 4, high tiltability design with gravity actuated valves similar to the ones shown in FIGS. 10, 11, and 12 combined with the two-pump configuration from one of the configurations described in FIGS. 17-31 would be a perfect fit. For applications that do not require the highest efficiency, one of the high-shell horizontal compressor models described in FIG. 5, 8, 9, 10, 11 or 12 may be used instead of the high/low-shell type of FIG. 4. In other words, one would select an appropriate, cost effective, horizontal rotary compressor model that would suit the application rather than choosing the best possible horizontal compressor model with all the features because of inevitable increase in compressor cost with each additional feature unless it is desirable for the application.

Figure 45A:
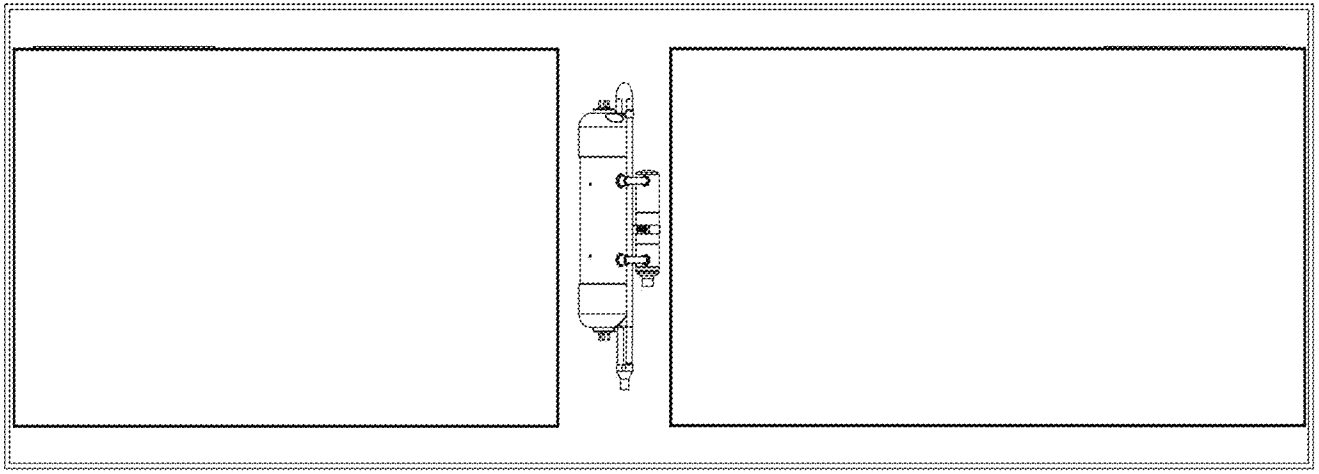
FIGS. 45A-45B depict one embodiment of a low front-to-back depth vertical vapor compression system to cool electronics inside a cabinet with an air cooled condenser installed horizontally and vertically.
Figure 45B:
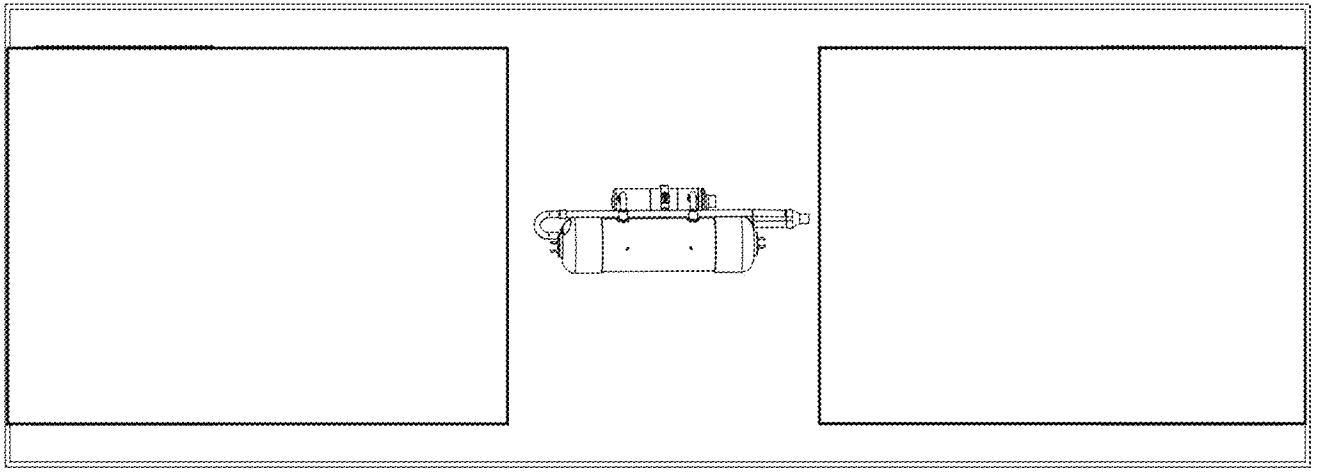

FIGS. 45A and 45B show a full-length vertical HVAC unit with very thin dimensions using the advanced horizontal rotary compressor. The HVAC unit can be as thin as 2U (3.5") deep so that it can be readily attached to the front, back or the side of a cabinet without taking up much space and can remove the heat generated inside the cabinet preferably by recycling the interior air using the air handling unit of the evaporator. These units shown in FIGS. 44A-44B and 45A-45B can easily be modified to become a cold-plate, direct expansion unit or a hybrid cold air/cold-plate direct expansion unit to selectively cool hot spots using appropriate cooling methods. Note that due to the expanded tiltability of the new horizontal rotary compressor, one can place an appropriate horizontal compressor either horizontally, vertically or any orientation in-between to accommodate the design needs for a particular system.

OTHER EXAMPLES

In some embodiments, a high-shell, nominally horizontally operating ("horizontal" herein after), roller piston/vane or scroll type, oil lubricated rotary compressor includes a space within the shell that is maintained at near its discharge pressure but divided into two spaces by a separator, one called motor space and the other pump space. The separator has an oil passage at the lower part and a gas passage in the upper part connecting the motor side and the pump side. The discharge gas out of the discharge valve enters the motor side first and goes through the motor to provide cooling for the motor and exits the motor into the discharge tube at the end of the motor side. In some embodiments, the compressor includes a gas tube, one end of which is connected to the gas passage of the separator and the other end extended toward and juts into the discharge tube without blocking the discharge tube, where the discharging gas flowing around the end of the gas tube and entering into the discharge tube induces flow of gas from the pump space into the motor space by the jet pump effect. The jet pump effect pulls the gas out of the pump space through the gas tube into the discharge tube, thereby lowering the pressure in the pump space slightly below discharge pressure causing the oil from the sump in the lower part of the motor space at discharge pressure flow into the sump in the lower part of the pump space. The flow of oil creates the pressure drop through the oil passage in the separator either in the form of an orifice at the lower section of the separator or a tube attached to the oil passage in the separator and extending into the motor space along the bottom of the shell in the motor space. The combination of the fact that the jet pump slightly decreases the pressure in the pump space to a pressure slightly lower than that of the motor space which is at discharge pressure, and the fact that there is a pressure drop in the oil flow path ensures that there is a pressure difference between the two spaces that causes the oil from the oil sump in the motor space to move to the oil sump in the pump space. In some embodiments, the level of oil sump in the pump space may be elevated higher than that of the oil sump in the motor space until an equilibrium is reached between the oil pumping force due to pressure difference between the two spaces and the gravitational force acting on the oil contained in the increased height portion of the oil sump in the pump space is achieved. The increased height of the oil sump level in the pump space contributes to ensuring adequate oil supply to the moving parts of the pump assembly and also increase the capability to operate in higher tilt angles without performance degradation. Such an embodiment is substantially similar to or natural extension of the embodiment shown in FIG. 5.

In some embodiments, a high-shell, horizontal, roller piston/vane or scroll type, horizontal compressor includes a space within the shell that is maintained at the discharge pressure but divided by a separator that acts as an oil dam between the motor space and the pump space with an oil passage at the lower part of the separator and a gas pressure equalization passage for the motor space and pump space at the upper part of the separator or above the separator. In some embodiments, the discharge gas out of the discharge valve enters the motor side and goes through the gap between the rotor and stator and/or outside the stator to provide cooling of the motor and exits the motor space into the discharge tube at the end of the motor space. In some embodiments, there is only one oil sump inside the shell which is in the motor space. In some embodiments, the oil from the sump flows directly into the pump assembly via an oil passage provided within one of a plurality of flanges, mid-plate in the case of a twin cylinder compressor, or through a tube connected to the flange nose substantially similar to the embodiment of FIGS. 8, 9, 10, 11, and 12. In some embodiments, the tube may be glued, screwed, or with the nose wall thickened sufficiently to prevent distortion of the flange bearing section during insertion of the tube into the bore. In some embodiments, the oil passage may be connected to a hole at the bottom side wall of the nose (which may be extended/thickened to prevent distortion of the flange during attachment operation of the tube and its nose end closed off). In some embodiments, the compressor may include a cap with a tube attached that goes over the regular flange nose, with or without seals and spring clasp.

In some embodiments, there is an oil supply tube attached to oil passage of the separator along the bottom of the shell with an appropriate length in order to ensure the end of the tube is still submerged in oil at a maximum allowable tilt angle clockwise and counterclockwise.

In some embodiments, a high-shell/low-shell, horizontal, roller piston/vane or scroll type, rotary compressor includes a pressure sealing separator between the motor space at low pressure that is independently controlled and the pump space at discharge pressure, where the oil in the sump on the motor space at discharge pressure directly feeds into the pump assembly via an oil passage provided in one of the flanges. The oil passage may be mid-plate in the case of a twin cylinder compressor, or through a tube connected to the flange nose where there may be an oil supply tube attached to oil passage of the separator along the bottom of the shell with an appropriate length in order to ensure the end of the tube is still submerged in oil at a maximum desired/allowable clockwise and counterclockwise pitch angle for the motor side.

In some embodiments, the oil supply tube comes equipped with one of more valves that get actuated by the gravity or electronically actuated according to the orientation of the compressor in order to further expand the tiltability of the horizontal compressor substantially similar to or variation of the embodiment of FIGS. 10 through 15.

In some embodiments, there are multiple pump assemblies inside a shell, where a pump assembly is either single or twin cylinder type. In some embodiments, each of the multiple pump assemblies is controlled by its own BLDC drive. In some embodiments, each BLDC drive is controlled by its controller or all of them by a common controller. In some embodiments, the multiple pumps can be arranged either pump assembly facing each other or away from each other. In some embodiments, multiple pumps can be completely separated by a pressure separator constituting multiple adjoined compressor configuration or multiple pumps within a single shell In some embodiments, the multiple compressors can be separated by a non-sealing separator, an oil dam, or pressure sealing separator.

In some embodiments, a horizontal rotary compressor includes multiple pump assemblies inside the shell, where a pump assembly is either single or twin cylinder type. In some embodiments, each of the multiple pump assemblies is controlled by its own BLDC drive. In some embodiments, each BLDC drive is controlled by its controller or all of them by a common controller. In some embodiments, the multiple pumps can be arranged either pump assembly facing each other or away from each other. In some embodiments, the multiple pumps can be completely separated by a pressure separator constituting multiple adjoined compressor configuration or multiple pumps within a single shell In some embodiments, the multiple compressors can be separated by a non-sealing separator, an oil dam, or pressure sealing separator.

In some embodiments, an oil lubricated roller-vane type rotary compressor (including rolling piston compressor, swing compressor, multi-vane compressor) includes an axis of rotation of the compressor pump and the motor is nominally horizontal. In some embodiments, the oil sump will form at the lower part within the shell due to gravity; where the lubricating oil from the sump flows into the moving parts of the compressor pump through the hollow core of the crank shaft which, in turn, is fed by a lubricant supply tube or passage whose one end is dipped into the oil sump. In some embodiments, the opposite end of the oil supply tube is attached to the flange nose or one of the flange disks or mid plate (in a twin cylinder model) housing an oil passage within to draw the oil from the sump and lead into the hollow core of the crankshaft. In some embodiments, the method of attachment or providing the internal passage would not distort the critical dimensional integrity of the flange or mid plate, such as flatness of the face of the flange or the mid plate, internal diameter of the flange bearing, etc. In some embodiments, the methods of attachment of the oil supply tube include the use of a tube with a slightly smaller diameter than the internal diameter of the flange bore can be inserted and glued without causing any dimensional changes or distortions, a cap with an attached tube may be glued to the flange, or the cap with an attached tube can be sealed with an O-ring and secured by a retaining spring, or in the cases of oil injection through an internal oil passage bored through the mid plate or one of the flanges, the oil flow passage can be pre-drilled before finish grinding operation.

In some embodiments an oil supply tube attached to the flange nose may be a simple tube fixed in its orientation with respect to the axis of the pump assembly, or with a 2-D or 3-D rotatable joint actuated by the gravity.

In some embodiments, a shell may be of a standard cylindrical shape or non-cylindrical with a bulge to store more oil and increase tiltability, where the bulge can be a circumferential bulge to better accommodate rotatable tube or a bulge in one location to accommodate a fixed oil supply tube.

In some embodiments, an oil supply tube is attached to a pump assembly to one of the following locations using rolling piston as an example: a tube attached to the end of the flange nose at the pump side and enter directly into the hollow core of the shaft, a tube attached to either one of the flange disks feeding into the "oil manifold" formed at the interface of the flange face and the cylinder block, a tube attached to the mid-plate of a twin cylinder type pump assembly feeding into the "oil manifold" formed by the shaft, internal hollow space of the mid plate and the two cylinders in a twin cylinder pump.

In some embodiments, a vapor compression system may utilizing any of the features herein to achieve high operational tiltability, low height in horizontal system, low front-to-back depth in a vertical vapor compression system, high turndown ratio with high part load efficiency, higher reliability, redundancy, higher capacity, higher reliability, and longer service life.

The invention claimed is:

1. A horizontal compressor comprising:

a shell divided into a motor space and a pump space by a separator, wherein the separator has an oil passage at a lower part of the separator and a gas passage in an upper part of the separator connecting the motor space and the pump space;

a motor positioned in the motor space including a rotor and a stator separated by a gap;

a pump assembly positioned in the pump space;

a sump positioned in a lower part of the shell in the motor space; and an oil supply tube extending between at least a portion of the sump positioned in the motor space and a portion of the separator, wherein the oil supply tube extends through the oil passage, wherein the sump is configured to feed oil collected in the motor space through the oil passage at the lower part of the separator and into the pump assembly to lubricate at least a portion of the pump assembly, and wherein an average pressure in the pump space is lower than an average pressure in the motor space.

2. The horizontal compressor of claim 1, further comprising at least one check valve configured to prevent back flow through the oil passage from the pump space to the motor space.

3. The horizontal compressor of claim 1, wherein the sump positioned in the motor space is a first sump, and further comprising a second sump positioned in the pump space.

4. The horizontal compressor of claim 3, further comprising a gas tube and a discharge tube, wherein the gas tube is configured to discharge a gas flow out of the pump space and into the discharge tube, and wherein flow of gas from the gas tube into the discharge tube evacuates refrigerant vapor from the pump space to lower a pressure inside of the pump space.

5. The horizontal compressor of claim 1, wherein the compressor is configured to inject at least some of the oil from the oil supply tube into an axial cavity of a crank shaft of the horizontal compressor.

6. The horizontal compressor of claim 5, wherein the compressor is configured to inject the at least some of the oil into the axial cavity of the crank shaft at an injection point located in a mid-plate of the pump assembly.

7. The horizontal compressor of claim 5, wherein the compressor is configured to inject the at least some of the oil into the axial cavity of the crank shaft at an injection point located in an outboard flange of the pump assembly.

8. The horizontal compressor of claim 5, wherein the compressor is configured to inject the at least some of the oil into the axial cavity of the crank shaft at an injection point located in an end cap of the crank shaft.

9. The horizontal compressor of claim 1, further comprising:

a first check valve; and a second check valve, wherein:

the first check valve is positioned proximate to an end of the oil supply tube;

the second check valve is positioned proximate to the separator;

the first and second check valves are gravity-activated such that a maximum pitch angle and maximum roll angle of the horizontal compressor is increased.

10. The horizontal compressor of claim 3, further comprising:

an oil suction tube in fluid communication with the second sump positioned in the pump space, wherein the oil suction tube is configured to feed oil from the second sump to an axial cavity of a crank shaft of the horizontal compressor.

11. The horizontal compressor of claim 4, wherein the compressor is configured to operate with a pressure inside the pump space lower than the pressure inside of the motor space such that oil is configured to flow from the first sump to the second sump.

12. The horizontal compressor of claim 1, further comprising a bulge in the pump space configured to store oil.

13. The horizontal compressor of claim 12, wherein the bulge is a circumferential bulge.

14. The horizontal compressor of claim 12, wherein the bulge is configured to increase a volume of the pump space along the lower part of the pump space.

* * * * *